US011807910B2

(12) United States Patent
Ueyama et al.

(10) Patent No.: US 11,807,910 B2
(45) Date of Patent: Nov. 7, 2023

(54) AUSTENITIC ALLOY PIPE AND METHOD FOR PRODUCING SAME

(71) Applicant: Nippon Steel Corporation, Tokyo (JP)

(72) Inventors: Masaki Ueyama, Tokyo (JP); Yusaku Tomio, Tokyo (JP); Yuhei Suzuki, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 133 days.

(21) Appl. No.: 16/617,765

(22) PCT Filed: Jun. 8, 2018

(86) PCT No.: PCT/JP2018/022122
§ 371 (c)(1),
(2) Date: Nov. 27, 2019

(87) PCT Pub. No.: WO2018/225869
PCT Pub. Date: Dec. 13, 2018

(65) Prior Publication Data

US 2021/0292864 A1 Sep. 23, 2021

(30) Foreign Application Priority Data

Jun. 9, 2017 (JP) ..... 2017-114286

(51) Int. Cl.
*C21D 9/08* (2006.01)
*C21D 6/00* (2006.01)
(Continued)

(52) U.S. Cl.
CPC ..... *C21D 9/08* (2013.01); *C21D 6/004* (2013.01); *C21D 6/005* (2013.01); *C21D 6/008* (2013.01);
(Continued)

(58) Field of Classification Search
CPC ..... C21D 9/08
See application file for complete search history.

(56) References Cited

U.S. PATENT DOCUMENTS

2003/0231976 A1 12/2003 Iseda
2004/0206427 A1* 10/2004 Iseda ..... C21D 8/005 148/609
(Continued)

FOREIGN PATENT DOCUMENTS

CN 103443318 A 12/2013
JP S58-6928 A 1/1983
(Continued)

OTHER PUBLICATIONS

"Austenitic stainless steels" 2008. ASM Handbooks. Stainless steels for design engineers. p. 69-78. (Year: 2008).*
(Continued)

*Primary Examiner* — Nicholas A Wang
(74) *Attorney, Agent, or Firm* — Banner & Witcoff, Ltd.

(57) ABSTRACT

Provided is an austenitic alloy pipe, which has high yield strength, excellent SCC resistance, suppressed strength anisotropy, and high detectability in ultrasonic flaw detection. The austenitic alloy pipe according to the present embodiment has a chemical composition consisting of: in mass %, C: 0.004 to 0.030%, Si: 1.00% or less, Mn: 0.30 to 2.00%, P: 0.030 or less, S: 0.0020% or less, Al: 0.001 to 0.100%, Cu: 0.50 to 1.50%, Ni: 25.00 to 55.00%, Cr: 20.00 to 30.00%, Mo: 2.00 to 10.00%, and N: 0.005 to 0.100%, with the balance being Fe and impurities. A grain size number of austenite crystal grain is 2.0 to 7.0 and a mixed grain ratio is not more than 5%. Tensile YS is not less than 758 MPa, compressive YS/tensile YS is 0.85 to 1.10, and an outer diameter is not less than 170 mm.

10 Claims, 2 Drawing Sheets

(51) Int. Cl.

| | |
|---|---|
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |

(52) U.S. Cl.

CPC ..... *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *C21D 2211/001* (2013.01)

(56) References Cited

U.S. PATENT DOCUMENTS

| | | | | |
|---|---|---|---|---|
| 2009/0084151 | A1* | 4/2009 | Hidaka | B21B 23/00 72/97 |
| 2014/0083576 | A1* | 3/2014 | Sawawatari | C22C 38/02 148/707 |
| 2015/0194227 | A1 | 7/2015 | Momozono et al. | |

FOREIGN PATENT DOCUMENTS

| | | | |
|---|---|---|---|
| JP | S63-203722 | A | 8/1988 |
| JP | 2012200762 | * | 10/2012 |

OTHER PUBLICATIONS

Carvill, J. Mechanical Engineer's Handbook. 2003. "engineering materials". p. 218-266. (Year: 2003).*
English Abstract of JP-S58-6928.
English Abstract of JP-S63-203722.

* cited by examiner

AUSTENITIC ALLOY PIPE AND METHOD FOR PRODUCING SAME

TECHNICAL FIELD

The present invention relates to an austenitic alloy pipe and a method for producing the same.

BACKGROUND ART

In oil wells and gas wells (in the present description, oil wells and gas wells are collectively called as "oil wells"), oil country tubular goods are used. Types of oil country tubular goods include casing pipes, tubing pipes, and the like. A casing pipe is inserted into an oil well. Cement is filled in between a casing pipe and a shaft wall, and the casing pipe is fixed in the shaft. The tubing pipe is inserted into the casing pipe, and allows product fluid such as crude oil and gas, etc. to flow inside.

Product fluid may contain hydrogen sulfide ($H_2S$) gas. Therefore, many of oil wells form a sour environment containing corrosive hydrogen sulfide. In the present description, a sour environment means an acidified environment containing hydrogen sulfide. The sour environment may contain not only hydrogen sulfide, but also carbon dioxide. For oil country tubular goods used in such a sour environment, excellent stress corrosion cracking resistance (SCC resistance) is required.

An austenitic alloy pipe, typified by an austenitic stainless pipe, has excellent SCC resistance. For that reason, austenitic alloy pipes have been used as oil country tubular goods. However, recently, further excellent SCC resistance is demanded.

An alloy pipe intended for improving SCC resistance has been proposed in Japanese Patent Application Publication No. 58-6928 (Patent Literature 1) and Japanese Patent Application Publication No. 63-203722 (Patent Literature 2).

The oil country tubular good disclosed in Patent Literature 1 is produced in the following manner. An alloy is prepared, which has a composition consisting of, in weight %, C: 0.05% or less, Si: 1.0% or less, Mn: 2.0% or less, P: 0.030% or less, S: 0.005% or less, sol. Al: 0.5% or less, Ni: 25 to 60%, Cr: 22.5 to 30%, further containing one or two types of element Mo: less than 8% and W: less than 16%, with the balance being Fe and unavoidable impurities, and which satisfies conditions of Cr (%)+10Mo (%)+5W (%)≥70%, and 4%≤Mo (%)+W (%)/2<8%. Thus prepared alloy is subjected to hot working under a condition that a wall thickness reduction rate at a temperature not more than a recrystallization temperature is not less than 10%. The alloy after hot working is subjected to heat treatment under a condition to hold it in a temperature range between a lower limit temperature (° C.) calculated by 260 log C (%)+1300 and an upper limit temperature (° C.) calculated by 16Mo (%)+10W (%)+10Cr (%)+777 for not more than two hours. The alloy after the heat treatment is subjected to cold working at a wall thickness reduction rate of 10 to 60%. By the production process described above, the oil country tubular good according to Patent Literature 1 is produced.

The tubular member disclosed in Patent Literature 2 is produced in the following manner. An alloy hollow shell is prepared, which has a composition consisting of, by weight %, C: 0.05% or less, Si: 1.0% or less, Mn: 2.0% or less, Ni: 30 to 60%, Cr: 15 to 30%, Mo: 1.5 to 12%, and Cu: 0.01 to 3.0%, with the balance being Fe and impurities. The prepared alloy hollow shell is subjected to plastic working at an area reduction rate of not less than 35% in a temperature range of 200° C. to normal temperature. The alloy hollow shell which has been subjected to plastic working is subjected to the following heating-cooling-cold working process one or more times. In the heating-cooling-cold working process, the alloy hollow shell is heated to and held at a temperature directly above a recrystallization temperature. Thereafter, the alloy hollow shell is cooled at a cooling rate not less than a cooling rate by air. The cooled alloy hollow shell is subjected to cold working.

CITATION LIST

Patent Literature

Patent Literature 1: Japanese Patent Application Publication No. 58-6928

Patent Literature 2: Japanese Patent Application Publication No. 63-203722

SUMMARY OF INVENTION

Technical Problem

Among oil country tubular goods, especially in oil country tubular goods having a diameter of not less than 170 mm, it is often the case that high strength of not less than 110 ksi grade (yield strength obtained by tensile test is 758 to 861 MPa) is required. Here, in the present description, an oil country tubular good with a diameter of not less than 170 mm is also referred to as a "large-diameter oil country tubular good". For a large-diameter oil country tubular good, excellent SCC resistance as well as high yield strength of not less than 758 MPa is required.

Further, in recent oil wells, in addition to traditional vertical shaft bores which are dug in a straight line vertically downward, inclined shaft bores have been increasing. An inclined shaft bore is formed by drilling in such a way that the extending direction of the shaft bore is bent from vertically downward to horizontal direction. Owing to including a horizontally extending portion (horizontal shaft bore), an inclined shaft bore can cover a wide range of stratum in which product fluids such as crude oil and gas, etc. are buried, thereby improving production efficiency of product fluids.

When a large-diameter oil country tubular good is used in such an inclined shaft bore, stress applied from directions other than a pipe axis direction may increase, unlike when it is used in a vertical shaft bore. For example, a large-diameter oil country tubular good, which is used in a portion curved from a vertical direction to a horizontal direction, receives stress from a direction different from that of a large-diameter oil country tubular good used in a vertical portion. Therefore, a large-diameter oil country tubular good used in an inclined shaft bore is preferably durable even when stress is applied from a direction other than a vertical direction. If strength anisotropy of large-diameter oil country tubular good can be suppressed, it can be durable in a curved portion of an inclined shaft bore as well, and therefore can be easily used in an inclined shaft bore.

Further, in a large-diameter oil country tubular good, it is preferable that external defects typified by surface flaws and internal defects typified by porosities can be detected before use. Therefore, higher detectability in ultrasonic flaw detection is preferable in a large-diameter oil country tubular good.

Further, an austenitic alloy pipe contains large amounts of alloying elements typified by Ni and Cr, etc. For that reason, scoring, etc. is likely to occur during the production process. If scoring occurs, flaws will remain on the surface of the austenitic alloy pipe. It is preferable to be able to suppress occurrence of such flaws.

An object of the present disclosure is to provide an austenitic alloy pipe which has high yield strength, excellent SCC resistance, suppressed strength anisotropy, and high detectability in ultrasonic flaw detection, and a method for producing the same.

Solution to Problem

An austenitic alloy pipe according to the present disclosure has a chemical composition consisting of: in mass %, C: 0.004 to 0.030%,
Si: 1.00% or less,
Mn: 0.30 to 2.00%,
P: 0.030 or less,
S: 0.0020% or less,
Al: 0.001 to 0.100%,
Cu: 0.50 to 1.50%,
Ni: 25.00 to 55.00%,
Cr: 20.00 to 30.00%,
Mo: 2.00 to 10.00%,
N: 0.005 to 0.100%,
Ti: 0 to 0.800%,
W: 0 to 0.30%,
Nb: 0 to 0.050%,
Ca: 0 to 0.0100%,
Mg: 0 to 0.0100%, and
Nd: 0 to 0.050%, with the balance being Fe and impurities, wherein a grain size number of austenite crystal grain is 2.0 to 7.0 and a mixed grain ratio is not more than 5%, wherein when a yield strength obtained by a compression test is defined as a compressive YS (MPa) and a yield strength obtained by a tensile test as a tensile YS (MPa), the tensile YS is not less than 758 MPa and the compressive YS/tensile YS is 0.85 to 1.10, and wherein the austenitic alloy pipe has an outer diameter of not less than 170 mm.

A method for producing an austenitic alloy pipe according to the present disclosure includes a starting material production step, a hollow shell production step, an intermediate cold working step, a grain refining step, and a final cold working step.

In the starting material production step, a cast piece which has been produced by a continuous casting process and has the above described chemical composition is heated at 1100 to 1350° C., and thereafter subjected to hot working at a reduction of area Rd0 which is in a range of 50.0 to 90.0% and satisfies Formula (1) to produce a starting material.

In the hollow shell production step, the starting material is heated at 1100 to 1300° C., and thereafter subjected to hot working at a reduction of area Rd1 which is in a range of 80.0 to 95.0% and satisfies Formula (1), to produce a hollow shell.

In the intermediate cold working step, the hollow shell is subjected to cold drawing at a reduction of area Rd2 which is in a range of 10.0 to 30.0% and satisfies Formula (1).

In the grain refining step, the hollow shell after the intermediate cold working step is held at 1000 to 1250° C. for 1 to 30 minutes and thereafter rapidly cooled.

In the final cold working step, the hollow shell after the grain refining step is subjected to cold drawing at a reduction of area Rd3 of 20.0 to 35.0% to produce the austenitic alloy pipe with an outer diameter of not less than 170 mm.

$$5\times Rd0+10\times Rd1+20\times Rd2\geq 1300 \quad (1)$$

Advantageous Effects of Invention

An austenitic alloy pipe according to the present disclosure has high yield strength, excellent SCC resistance, suppressed strength anisotropy, and high detectability in ultrasonic flaw detection. Further, a method for producing an austenitic alloy pipe according to the present disclosure enables production of an austenitic alloy pipe, which has high yield strength, excellent SCC resistance, suppressed strength anisotropy, and high detectability in ultrasonic flaw detection, and in which occurrence of surface flaws is suppressed.

DESCRIPTION OF EMBODIMENTS

The present inventors have conducted investigation and research on strength, SCC resistance, strength anisotropy, and detectability in ultrasonic flaw detection of an austenitic alloy pipe with a diameter of not less than 170 mm. As a result of that, they have obtained the following findings. Hereinafter, in the present description, an austenitic alloy pipe with a diameter of not less than 170 mm is also referred to as a "large-diameter austenitic alloy pipe".

(1) Let the chemical composition of large-diameter austenitic alloy pipe be a chemical composition consisting of: in mass %, C: 0.004 to 0.030%, Si: 1.00% or less, Mn: 0.30 to 2.00%, P: 0.030 or less, S: 0.0020% or less, Al: 0.001 to 0.100%, Cu: 0.50 to 1.50%, Ni: 25.00 to 55.00%, Cr: 20.00 to 30.00%, Mo: 2.00 to 10.00%, N: 0.005 to 0.100%, Ti: 0 to 0.800%, W: 0 to 0.30%, Nb: 0 to 0.050%, Ca: 0 to 0.0100%, Mg: 0 to 0.0100%, and Nd: 0 to 0.050%, with the balance being Fe and impurities. In this case, based on a premise that other conditions described below (the following items (2) to (4)) are satisfied, it is possible to achieve a yield strength (hereinafter, referred to as tensile YS, and its unit is MPa) of not less than 110 ksi grade (tensile YS is 758 to 861 MPa), which is obtained by a tensile test at room temperature (25° C.) in the atmosphere by using a tensile test specimen (with a parallel-portion diameter of 6 mm, and a parallel-portion length of 30 mm) specified in ASTM E8M-16a, and also possible to achieve excellent SCC resistance.

(2) In a large-diameter austenitic alloy pipe having the chemical composition of the above described (1), if the grain size number of austenite crystal grain conforming to ASTM E112 is made not less than 2.0, detectability in ultrasonic flaw detection will be improved. Hereinafter, in the present description, the grain size number of austenite crystal grain means the grain size number conforming to ASTM E112.

Figure 1:
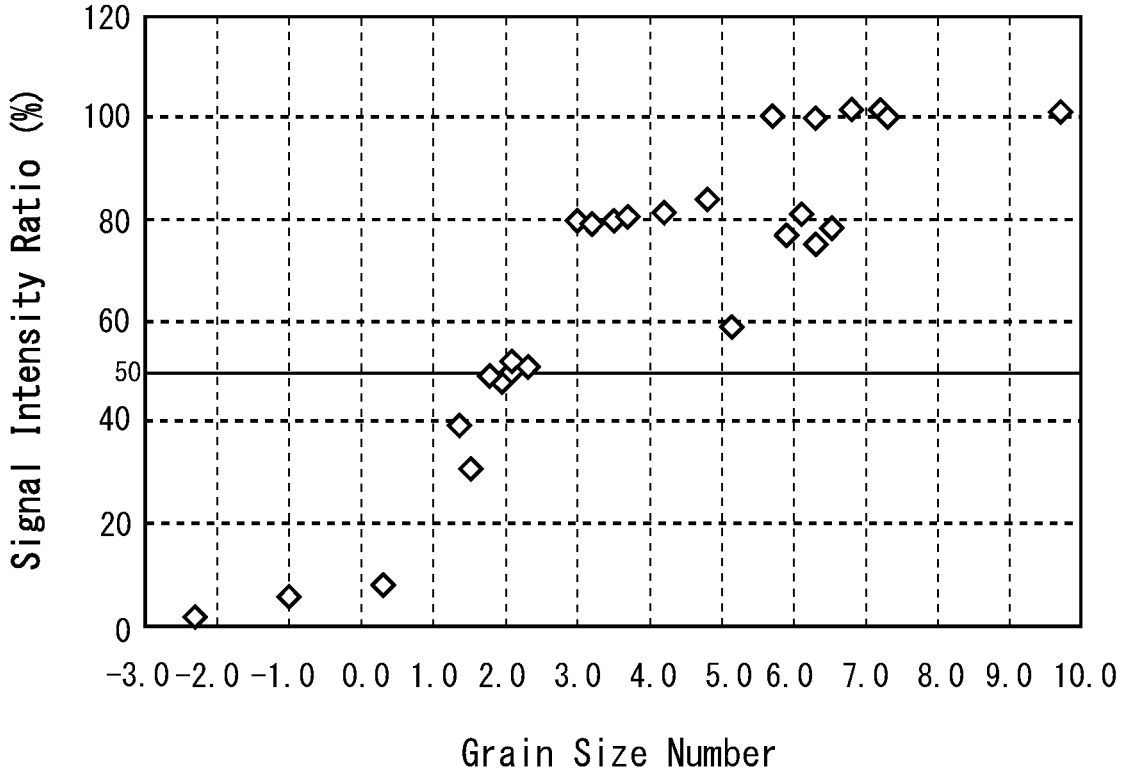
FIG. 1 is a diagram showing the relation between the grain size number of austenite crystal grain and detectability in ultrasonic flaw detection of austenitic alloy pipe.

FIG. 1 is a diagram showing relation between the grain size number of austenite crystal grain and detectability (signal intensity ratio) of ultrasonic flaw detection of a large-diameter austenitic alloy pipe. FIG. 1 was obtained in the following manner.

Figure 2:
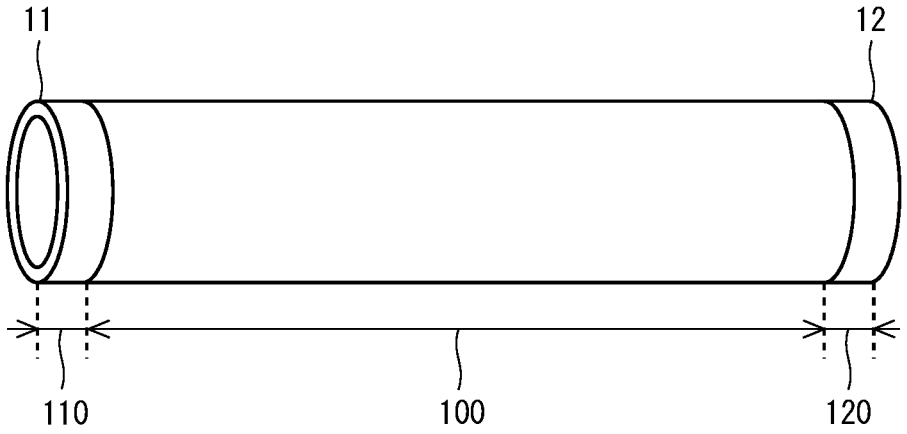
FIG. 2 is a perspective view of an austenitic alloy pipe.

A plurality of large-diameter austenitic alloy pipes having an outer diameter of not less than 170 mm, a chemical composition of the above described (1), and various grain size numbers were prepared. FIG. 2 shows a perspective view of a large-diameter austenitic alloy pipe. As shown in FIG. 2, the austenitic alloy pipe includes a first pipe-end region 110, a second pipe-end region 120, and a main body region 100. The first pipe-end region 110 is in a range of 500 mm from a first pipe end 11 toward a middle in an axial direction of the austenitic alloy pipe. In other words, the first pipe-end region 110 has an axial length of 500 mm. The second pipe-end region 120 is in a range of 500 mm from a second pipe end 12, which is located on the opposite side of the first pipe end 11, toward the middle in the axial direction of the austenitic alloy pipe. In other words, the second pipe-end region 120 has an axial length of 500 mm. The main body region 100 is a portion of the large-diameter austenitic alloy pipe excluding the first pipe-end region 110 and the second pipe-end region 120.

Figure 3:
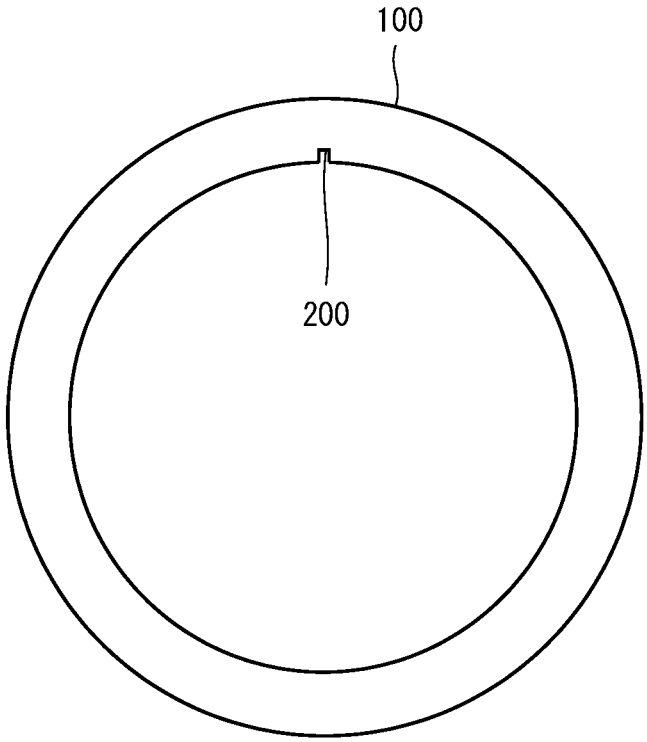
FIG. 3 is a cross-sectional view of a sample of ultrasonic flaw detection test.

The main body region 100 of each large-diameter austenitic alloy pipe was divided into five equal parts in the axial direction (longitudinal direction). From each section, an annular sample which had an axial length of large-diameter austenitic alloy pipe of 100 mm was picked up. As shown in FIG. 3, an artificial flaw 200, which was a column-shaped hole extending in a radial direction (wall thickness direction), was made in an axially middle part in the inner peripheral surface of each sample. The artificial flaw 200 had a diameter of 3 mm.

Ultrasonic wave was outputted (entered) toward the artificial flaw 200 from an outer surface of the sample by using an ultrasonic flaw detection apparatus, and ultrasonic wave reflected at the artificial flaw 200 was received and observed as an echo. The intensity of ultrasonic wave entered was the same for every sample. An average of (a total of five) signal intensities of echoes of the artificial flaw 200, which were obtained from samples of each section, was defined as the signal intensity in the large-diameter austenitic alloy pipe.

The signal intensity in the large-diameter austenitic alloy pipe of Test No. 1 (grain size number was 5.7) in Table 1 to be described later was defined as 100. In other words, the signal intensity of an echo reflected at an artificial flaw formed in the inner surface of a large-diameter austenitic alloy pipe of the present embodiment, which had the above described chemical composition, and in which the grain size number was 5.7, was set as a reference. Then, a ratio of the signal intensity obtained in each of the large-diameter austenitic alloy pipes of various grain size numbers to the signal intensity obtained in the large-diameter austenitic alloy pipe of Test No. 1 was defined as a signal intensity ratio (%). When the signal intensity ratio was more than 50.0%, it was judged that detectability in ultrasonic flaw detection was excellent. FIG. 1 was created based on the obtained signal intensity ratios (%) and grain size numbers.

Referring to FIG. 1, when the grain size number was less than 2.0, the signal intensity ratio became less than 50.0%, and the signal intensity ratio significantly decreased as the grain size number decreased. However, when the grain size number was not less than 2.0, the signal intensity ratio significantly increased as the grain size number increased. Then, when the grain size number was not less than 7.0, the signal intensity ratio reached 100%, thus being saturated. In other words, in the relation between the grain size number and the detectability in ultrasonic flaw detection, there was a point of inflection in the neighborhood of the grain size number=2.0.

Based on the findings described so far, if the grain size number of austenite crystal grain is 2.0 to 7.0 in a large-diameter austenitic alloy pipe having an outer diameter of not less than 170 mm and the chemical composition of the above described (1), the detectability in ultrasonic flaw detection will be remarkably improved on a condition that other conditions (the above described item (1) and the below described item (4)) are satisfied.

Note that if the grain size number is more than 7.0 in a large-diameter austenitic alloy pipe, a surface flaw is likely to occur in the large-diameter austenitic alloy pipe in the production process. Accordingly, an upper limit of the grain size number is set to 7.0.

(3) If the grain size number of austenite crystal grain of the large-diameter austenitic alloy pipe having the chemical composition of the above described (1) is set to 2.0 to 7.0, not only the detectability of ultrasonic flaw detection is improved, but also strength anisotropy can be suppressed.

Figure 4:
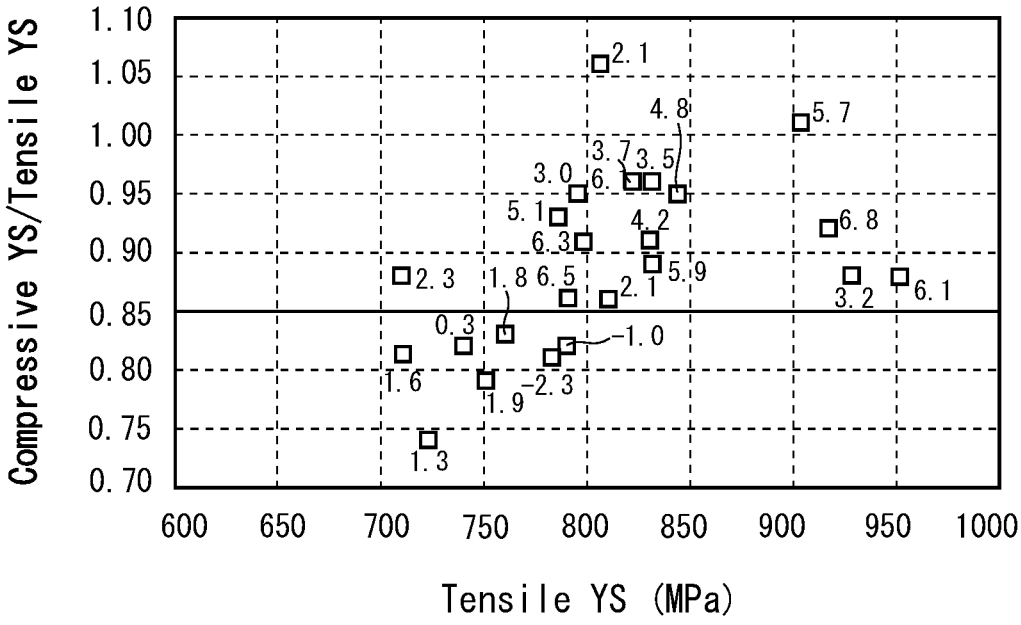
FIG. 4 is a diagram showing the relation among the grain size number of austenite crystal grain, the yield strength, and the strength anisotropy of austenitic alloy pipe.

FIG. 4 is a diagram showing the relation among the grain size number of austenite crystal grain, the yield strength (tensile YS), and the strength anisotropy (compressive YS/tensile YS) of the large-diameter austenitic alloy pipe having the chemical composition of the above described (1). A numeral value near a mark (□) in FIG. 4 shows grain size number at the position of the mark. FIG. 4 was obtained in the following manner.

The tensile YS (MPa) which is yield strength obtained by tensile test was determined in the following manner. A plurality of large-diameter austenitic alloy pipes, which have an outer diameter of 170 mm to 296 mm, a chemical composition of the above described (1), and various grain size numbers, were prepared. The main body region 100 shown in FIG. 2 was divided into five equal parts in the axial direction of alloy pipe. Then, a tensile test specimen (a parallel-portion diameter of 6 mm and a parallel-portion length of 30 mm) specified in ASTM E8M-16a was picked up from a wall-thickness middle part of each section. The parallel portion of the tensile test specimen was in parallel with the axial direction of the large-diameter austenitic alloy pipe. Using the picked-up tensile test specimens, a tensile test was performed at the room temperature (25° C.) in the atmosphere to determine yield strength. The yield strength was obtained as 0.2% proof stress. An average of yield strength obtained in each section was regarded as yield strength obtained by tensile test (tensile YS in the unit of MPa).

Compressive YS (MPa) which is yield strength obtained by compression test was determined in the following manner. A column-shaped compression test specimen was picked up from a wall-thickness middle part of each section which is one of five equal parts divided in the axial direction of the main body region 100 of the above described large-diameter austenitic alloy pipe. The compression test specimen had a diameter of 6.35 mm and a length of 12.7 mm. The longitudinal direction of the compression test specimen was in parallel with the axial direction of the austenitic alloy pipe. Using the picked-up compression test specimen, compression test was performed conforming to ASTM E9-09 in the atmosphere at the room temperature (25° C.) to obtain yield strength. An average of yield strength obtained in each section was defined as yield strength obtained by compression test (compressive YS in the unit of MPa). The yield strength was obtained as 0.2% proof stress.

Using obtained tensile YS and compressive YS, an anisotropy index AN was determined based on the following Formula.

Anisotropy index AN=compressive YS/tensile YS

FIG. 4 was created based on the obtained anisotropy index AN (=compressive YS/tensile YS), grain size number, and tensile YS. The ordinate of FIG. 4 is the anisotropy index AN (=compressive YS/tensile YS), and the abscissa is the tensile YS (MPa). It is seen that as compressive YS/tensile YS becomes closer to 1.00, the strength anisotropy is further suppressed. Note that the grain size number of a large-diameter austenitic alloy of each mark was determined in the manner described in examples described below.

Referring to FIG. 4, when tensile YS is not less than 758 MPa, if grain size number is not less than 2.0, the anisotropy index AN (=compressive YS/tensile YS) remains in a range of 0.85 to 1.10, and thus strength anisotropy is suppressed.

Based on the above described findings, in a large-diameter austenitic alloy pipe having an outer diameter of not less than 170 mm and the chemical composition of the above described (1), if the grain size number of austenite crystal grain is 2.0 to 7.0, not only detectability in ultrasonic flaw detection is remarkably improved, but also strength anisotropy can be suppressed on a condition that other conditions (the above described item (1) and the below described item (4)) are satisfied. Specifically, a ratio of the compressive yield strength (compressive YS) obtained by compression test conforming to ASTM E9-09 to the tensile yield strength (tensile YS) obtained by tensile test conforming to ASTM E8M-16a will be 0.85 to 1.10.

(4) In a large-diameter austenitic alloy pipe, which has a chemical composition of the above described (1), whose strength grade is not less than 110 ksi grade (tensile YS is 758 MPa), and whose grain size number is 2.0 to 7.0, if, further, its microstructure is substantially in a state of regulated grain, the austenitic alloy pipe will have excellent SCC resistance as well.

In other words, even when grain size number is 2.0 to 7.0 in a large-diameter austenitic alloy pipe having the chemical composition of the above described (1), if the microstructure is in a state of mixed grain, SCC becomes likely to occur at grain boundaries with different grain sizes.

If, among twenty samples picked up from large-diameter austenitic alloy pipes having the above described chemical composition, strength, and grain size number, by the below described method, a proportion of the number of samples in which a state of "mixed grain" has occurred (mixed grain ratio) is not more than 5%, the microstructure of large-diameter austenitic alloy pipe is substantially in a state of regulated grain, thus exhibiting excellent SCC resistance.

(5) A large-diameter austenitic alloy pipe having the above described configuration can be produced by performing, for example, the following production method. This production method includes a starting material production step, a hollow shell production step, an intermediate cold working step, a grain refining step, and a final cold working step. In the starting material production step, a cast piece produced by a continuous casting process is subjected to hot working to produce a starting material. In the hollow shell production step, the starting material is subjected to hot working to produce a hollow shell. In the intermediate cold working step, the hollow shell is subjected to cold drawing.

The reduction of area in the starting material production step is defined as a reduction of area Rd0. The reduction of area in the hollow shell production step is defined as a reduction of area Rd1. The reduction of area in the intermediate cold working step is defined as a reduction of area Rd2. The reduction of area in the final cold working step is defined as a reduction of area Rd3. By adjusting reductions of area Rd0 to Rd3 in an appropriate range, it is possible to adjust the grain size number of a large-diameter austenitic alloy pipe, and achieve a microstructure in a state of regulated grain. For example, when the reduction of area Rd0 of the starting material production step and the reduction of area Rd1 of the hollow shell production step are too low, although the grain size number can be adjusted to be not less than 2.0, a state of regulated grain may not be achieved, even if the reduction of area Rd2 is increased in the intermediate cold working step. Further, the reduction of area Rd2 in the intermediate cold working step becomes too high, scoring will occur in dies, and flaws will remain on the surface of the austenitic alloy pipe after the final cold working step.

Accordingly, in the present embodiment, adjustments are made such that the reduction of area Rd0 in the starting material production step is 50.0 to 90.0%; the reduction of area Rd1 in the hollow shell production step is 80.0 to 95.0%; and the reduction of area Rd2 in the intermediate cold working step is 10.0 to 30.0%, and further such that the reduction of area Rd3 in the final cold working step after the grain refining step is 20.0 to 35.0%.

Further, in the present embodiment, the reduction of area Rd0 in the starting material production step, the reduction of area Rd1 in the hollow shell production step, and the reduction of area Rd2 in the intermediate cold working step are adjusted so as to satisfy Formula (1).

$$5\times Rd0+10\times Rd1+20\times Rd2\geq 1300 \quad (1)$$

Where, "Rd0" in Formula (1) is substituted by the reduction of area Rd0(%) in the starting material production step. "Rd1" is substituted by the reduction of area Rd1(%) in the hollow shell production step. "Rd2" is substituted by the reduction of area Rd2(%) in the intermediate cold working step. When definition is made as F1=5×Rd0+10×Rd1+20×Rd2, the figure in the first decimal place of an obtained value of F1 is rounded off In this case, in the austenitic alloy pipe of the above described chemical composition, scoring is suppressed, and thereby occurrence of flaws on the surface of the austenitic alloy pipe is suppressed as a result of that the grain size number becomes in a range of 2.0 to 7.0, and a mixed grain ratio becomes not more than 5%, and further the reduction of area Rd2 is suppressed from becoming excessive. Further, by adjusting strength within a range of the reduction of area Rd3 of 20.0 to 35.0% in the final cold working step, the tensile YS of the austenitic alloy pipe will be not less than 758 MPa, and the anisotropy index AN (=compressive YS/tensile YS) will fall in a range of 0.85 to 1.10.

The austenitic alloy pipe according to the present embodiment which has been completed based on the above described findings has a chemical composition consisting of: in mass %, C: 0.004 to 0.030%,
Si: 1.00% or less,
Mn: 0.30 to 2.00%,
P: 0.030 or less, S: 0.0020% or less,
Al: 0.001 to 0.100%,
Cu: 0.50 to 1.50%,
Ni: 25.00 to 55.00%,
Cr: 20.00 to 30.00%,
Mo: 2.00 to 10.00%,
N: 0.005 to 0.100%,
Ti: 0 to 0.800%,
W: 0 to 0.30%,
Nb: 0 to 0.050%,
Ca: 0 to 0.0100%,
Mg: 0 to 0.0100%, and
Nd: 0 to 0.050%,
with the balance being Fe and impurities, wherein a grain size number of austenite crystal grain is 2.0 to 7.0, and a mixed grain ratio is not more than 5%, wherein when a yield strength obtained by a compression test is defined as a compressive YS (MPa) and a yield strength obtained by a tensile test as a tensile YS (MPa), the tensile YS is not less than 758 MPa and the compressive YS/tensile YS is 0.85 to 1.10, and wherein the austenitic alloy pipe has an outer diameter of not less than 170 mm.

The chemical composition of the above described austenitic alloy pipe may contain one or more types of element selected from the group consisting of Ti: 0.005 to 0.800%,
W: 0.02 to 0.30%, and
Nb: 0.001 to 0.050%.

The chemical composition of the above described austenitic alloy pipe may contain one or more types of element selected from the group consisting of:

Ca: 0.0003 to 0.0100%,
Mg: 0.0005 to 0.0100%, and
Nd: 0.010 to 0.050%.

A method for producing an austenitic alloy pipe according to the present embodiment includes a starting material production step, a hollow shell production step, an intermediate cold working step, a grain refining step, and a final cold working step.

In the starting material production step, a cast piece which has been produced by a continuous casting process and has the above described chemical composition is heated at 1100 to 1350° C., and thereafter subjected to hot working at a reduction of area Rd0 which is in a range of 50.0 to 90.0% and satisfies Formula (1) to produce a starting material.

In the hollow shell production step, the starting material is heated at 1100 to 1300° C., and thereafter subjected to hot working at a reduction of area Rd1 which is in a range of 80.0 to 95.0% and satisfies Formula (1), to produce a hollow shell.

In the intermediate cold working step, the hollow shell is subjected to cold drawing at a reduction of area Rd2 which is in a range of 10.0 to 30.0% and satisfies Formula (1).

In the grain refining step, the hollow shell after the intermediate cold working step is held at 1000 to 1250° C. for 1 to 30 minutes and thereafter rapidly cooled.

In the final cold working step, the hollow shell after the grain refining step is subjected to cold drawing at a reduction of area Rd3 of 20.0 to 35.0% to produce an austenitic alloy pipe with an outer diameter of not less than 170 mm.

$$5\times Rd0+10\times Rd1+20\times Rd2\geq 1300 \quad (1)$$

Hereinafter, the austenitic alloy pipe of the present embodiment will be described in detail. Note that "%" as used herein relating to a chemical element means, unless otherwise stated, mass %.

[Outer Diameter of Austenitic Alloy Pipe]

The austenitic alloy pipe of the present embodiment is intended for a so-called large-diameter alloy pipe. Specifically, the austenitic alloy pipe of the present embodiment has a diameter of not less than 170 mm. A lower limit of the diameter of the austenitic alloy pipe is preferably, for example, 180 mm, more preferably 190 mm, further preferably 200 mm, and further preferably 210 mm, and even further preferably 220 mm. An upper limit of the diameter of the austenitic alloy pipe of the present embodiment is, though not particularly limited, for example, 350 mm. An upper limit of the diameter of the austenitic alloy pipe is preferably, for example, 340 mm and more preferably 320 mm. The wall thickness of the austenitic alloy pipe of the present embodiment is, though not particularly limited, for example, 7 to 40 mm.

[Chemical Composition of Austenitic Alloy Pipe]

The chemical composition of the large-diameter austenitic alloy pipe of the present embodiment contains the following elements.

[Essential Elements]

C: 0.004 to 0.030%

Carbon (C) increases the strength of a large-diameter austenitic alloy pipe. When the C content is less than 0.004%, the above described effect cannot be sufficiently achieved. On the other hand, when the C content is more than 0.030%, Cr carbide is formed at grain boundaries. Cr carbide increases cracking susceptibility at grain boundaries. As a result, SCC resistance of the large-diameter austenitic alloy pipe deteriorates. Accordingly, the C content is 0.004 to 0.030%. A lower limit of the C content is preferably 0.006%, more preferably 0.007%, and further preferably 0.008%. An upper limit of the C content is preferably 0.024%, more preferably 0.023%, and further preferably 0.020%.

Si: 1.00% or Less

Silicon (Si) is unavoidably contained. Therefore, the Si content is more than 0%. Si is used to deoxidize an alloy, and as a result, is contained in a large-diameter austenitic alloy pipe. When the Si content is more than 1.00%, hot workability of the large-diameter austenitic alloy pipe deteriorates. Accordingly, the Si content is not more than 1.00%. An upper limit of the Si content is preferably 0.80%, more preferably 0.60%, and further preferably 0.50%. A lower limit of the Si content is not particularly limited. However, excessive decrease of the Si content will increase the production cost. Therefore, considering industrial operation, a lower limit of the Si content is preferably 0.0005%, more preferably 0.005%, further preferably 0.10%, and further preferably 0.20%.

Mn: 0.30 to 2.00%

Manganese (Mn) is an austenite forming element and stabilizes austenite in an alloy. Mn further increases solubility of N into an alloy. Therefore, Mn particularly suppresses generation of pinholes near the surface of a large-diameter austenitic alloy pipe when the N content is increased to increase the strength of the alloy. When the Mn content is less than 0.30%, such effects cannot be sufficiently achieved. On the other hand, when the Mn content is more than 2.00%, hot workability of a large-diameter austenitic alloy deteriorates. Accordingly, the Mn content is 0.30 to 2.00%. A lower limit of the Mn content is preferably 0.40%, more preferably 0.45%, and further preferably 0.50%. An upper limit of the Mn content is preferably 1.50%, more preferably 1.20%, further preferably 0.90% and further preferably 0.80%.

P: 0.030% or Less

Phosphorous (P) is an unavoidably contained impurity. In other words the P content is more than 0%. P increases stress corrosion cracking susceptibility of an alloy in a sour environment. Accordingly, the P content is 0.030% or less. An upper limit of the P content is preferably 0.028%, and more preferably 0.025%. The P content is preferably as little as possible. However, excessive reduction of the P content will increase production cost. Therefore, considering industrial manufacturing, a lower limit of the P content is preferably 0.0001%, more preferably 0.0005%, and further preferably 0.001%.

S: 0.0020% or Less

Sulfur (S) is an unavoidably contained impurity. In other words, the S content is more than 0%. S deteriorates hot workability of an alloy. Accordingly, the S content is 0.0020% or less. An upper limit of the S content is preferably 0.0015%, more preferably 0.0012%, further preferably 0.0009%, and further preferably 0.0008%. The S content is preferably as low as possible. However, excessive decrease of the P content will increase the production cost. Therefore, considering industrial manufacturing, a lower limit of the P content is preferably 0.0001%, more preferably 0.0003%, and further preferably 0.0005%.

Al: 0.001 to 0.100%

Aluminum (Al) deoxidizes an alloy. Al forms oxide to immobilize oxygen, thereby suppressing formation of Si oxide and Mn oxide. This improves hot workability of the alloy. When the Al content is less than 0.001%, this effect cannot be sufficiently achieved. On the other hand, when the Al content is more than 0.100%, Al oxide is excessively formed, thereby rather deteriorating hot workability of the alloy. Accordingly, the Al content is 0.001 to 0.100%. A lower limit of the Al content is preferably 0.005%, more preferably 0.010%, and further preferably 0.012%. An upper limit of the Al content is preferably 0.080%, more preferably 0.060%, and further preferably 0.050%.

Cu: 0.50 to 1.50%

Copper (Cu) improves SCC resistance of an alloy in a sour environment. When the Cu content is less than 0.50%, this effect cannot be sufficiently achieved. On the other hand, when the Cu content is more than 1.50%, hot workability of the alloy deteriorates. Accordingly, the Cu content is, in mass %, 0.50 to 1.50%. A lower limit of the Cu content is preferably 0.60%, more preferably 0.65%, and further preferably 0.70%. An upper limit of the Cu content is preferably 1.40%, more preferably 1.20%, and further preferably 1.00%.

Ni: 25.00 to 55.00%

Nickel (Ni) is an austenite forming element and stabilizes austenite in an alloy. Ni further forms Ni sulfide film on the surface of the alloy, thereby improving SCC resistance of the alloy. When the Ni content is less than 25.00%, these effects cannot be sufficiently achieved. On the other hand, when the Ni content is more than 55.00%, the N solubility limit decreases, thereby decreasing the strength of austenitic alloy pipe. Accordingly, the Ni content is 25.00 to 55.00%. A lower limit of the Ni content is preferably 27.00%, more preferably 28.00%, and further preferably 29.00%. An upper limit of the Ni content is preferably 53.00%, more preferably 52.0%, and further preferably 51.00%.

Cr: 20.00 to 30.00%

Chromium (Cr) improves SCC resistance of an alloy in the coexistence with Ni. Cr further increases strength of the alloy by solid-solution strengthening. When the Cr content is less than 20.00%, these effects cannot be sufficiently achieved. On the other hand, when the Cr content is more than 30.00%, hot workability of the alloy deteriorates. Accordingly, the Cr content is 20.00 to 30.00%. A lower limit of the Cr content is preferably 21.00%, more preferably 22.00%, and further preferably 23.00%. An upper limit of the Cr content is preferably 29.00%, more preferably 27.00%, and further preferably 26.00%.

Mo: 2.00 to 10.00%

Molybdenum (Mo) improves SCC resistance of an alloy in the coexistence with Cr and Ni. Further, Mo increases strength of the alloy by solid-solution strengthening. When the Mo content is less than 2.00%, these effects cannot be sufficiently achieved. On the other hand, when the Mo content is more than 10.00%, hot workability of the alloy deteriorates. Accordingly, the Mo content is 2.00 to 10.00%. A lower limit of the Mo content is preferably 2.20%, more preferably 2.40%, and further preferably 2.50%. An upper limit of the Mo content is preferably 9.50%, more preferably 9.00%, and further preferably 7.00%.

N: 0.005 to 0.100%

Nitrogen (N) increases strength of an alloy by solid-solution strengthening. In the austenitic alloy pipe according to the present embodiment, the C content is suppressed to be low to improve SCC resistance. For that reason, N is contained in a large amount in place of C to increase the strength of the alloy. When the N content is less than 0.005%, these effects cannot be sufficiently achieved. On the other hand, when the N content is more than 0.100%, pinholes are likely to be generated near the surface of the alloy when the alloy solidifies. When the N content is more than 0.100%, further, hot workability of the alloy deteriorates. Accordingly, the N content is 0.005 to 0.100%. A lower limit of the N content is preferably 0.008%, and more preferably 0.010%. An upper limit of the N content is preferably 0.095%, and more preferably 0.090%.

The balance of the chemical composition of the austenitic alloy pipe according to the present embodiment consists of Fe and impurities. Where, the term "impurities" means those elements which are mixed from ores and scraps as the raw material, or from a production environment, etc. when the large-diameter austenitic alloy pipe is industrially produced, and which are permitted within a range not remarkably and adversely affecting the operational advantages of the austenitic alloy pipe of the present embodiment.

The above described impurities may include O (oxygen). When O is contained as an impurity, the upper limit of the O content is, for example, as follows.

O: 0.0010% or Less

[Optional Elements]

The chemical composition of the austenitic alloy pipe according to the present embodiment may further contain one or more types of element selected from the group consisting of Ti, W, and Nb. All of these elements increase strength of the alloy.

Ti: 0 to 0.800%

Titanium (Ti), which is an optional element, may not be contained. In other words, the Ti content may be 0%. When contained, Ti facilitates grain refinement in the coexistence with C and N. Further, Ti increases strength of an alloy by precipitation strengthening. However, when the Ti content is more than 0.800%, hot workability of the alloy deteriorates. Accordingly, the Ti content is, in mass %, 0 to 0.800%. A lower limit of the Ti content is preferably more than 0%, more preferably 0.005%, further preferably 0.030%, and further preferably 0.050%. An upper limit of the Ti content is preferably 0.750%, and more preferably 0.700%.

W: 0 to 0.30%

Tungsten (W), which is an optional element, may not be contained. In other words, the W content may be 0%. When contained, W improves SCC resistance of an alloy in the coexistence with Cr and Ni. Further, W increases strength of the alloy by solid-solution strengthening. However, the W content is more than 0.30%, hot workability of the alloy deteriorates. Accordingly, the W content is, in mass %, 0 to 0.30%. A lower limit of the W content is preferably more than 0%, more preferably 0.02%, and further preferably 0.04%. An upper limit of the W content is preferably 0.25%, and more preferably 0.20%.

Nb: 0 to 0.050%

Niobium (Nb), which is an optional element, may not be contained. In other words, the Nb content may be 0%. When contained, Nb facilitates grain refinement in the coexistence with C and N. Further, Nb increases strength of the alloy by precipitation strengthening. However, when the Nb content is too high, hot workability of the alloy deteriorates. Accordingly, the Nb content is 0 to 0.050%. A lower limit of the Nb content is preferably more than 0%, more preferably 0.001%, further preferably 0.008%, and further preferably 0.010%. An upper limit of the Nb content is preferably 0.045%, and more preferably 0.040%.

The chemical composition of the austenitic alloy pipe according to the present embodiment may contain one or more types of element selected from the group consisting of Ca, Mg, and Nd. All of these elements improve hot workability of the alloy.

Ca: 0 to 0.0100%

Calcium (Ca), which is an optional element, may not be contained. In other words, the Ca content may be 0%. When contained, Ca combines with S to form sulfide, thereby decreasing dissolved S. As a result of this, Ca improves hot workability of the alloy. However, when the Ca content is more than 0.0100%, coarse oxide is formed and hot workability of the alloy rather deteriorates. Accordingly, the Ca content is 0 to 0.0100%. A lower limit of the Ca content is preferably more than 0%, more preferably 0.0003%, and further preferably 0.0005%. An upper limit of the Ca content is preferably 0.0080%, and more preferably 0.0060%.

Mg: 0 to 0.0100%

Magnesium (Mg), which is an optional element, may not be contained. In other words, the Mg content may be 0%. When contained, Mg, as with Ca, combines with S to form sulfide, thereby decreasing dissolved S. As a result, Mg improves hot workability of the alloy. However, when the Mg content is more than 0.0100%, coarse oxide is formed, and hot workability of the alloy rather deteriorates. Accordingly, the Mg content is 0 to 0.0100%. A lower limit of the Mg content is preferably more than 0%, more preferably 0.0005%, and further preferably 0.0007%. An upper limit of the Ca content is preferably 0.0080%, more preferably 0.0060%, and further preferably 0.0050%.

Nd: 0 to 0.050%

Neodymium (Nd), which is an optional element, may not be contained. In other words, the Nd content may be 0%. When contained, Nd, as with Ca and Mg, combines with S to form sulfide, thereby decreasing dissolved S. As a result, Nd improves hot workability of the alloy. However, when the Nd content is more than 0.050%, coarse oxide is formed and hot workability of the alloy rather deteriorates. Accordingly, the Nd content is 0 to 0.050%. A lower limit of the Nd content is preferably more than 0%, more preferably 0.010%, and further preferably 0.020%. An upper limit of the Nd content is preferably 0.040%, and more preferably 0.035%.

[Grains Size]

In the microstructure of the austenitic alloy pipe of the present embodiment, the grain size number of austenite crystal grain conforming to ASTM E112 is 2.0 to 7.0. Moreover, in the microstructure of the austenitic alloy pipe of the present embodiment, the mixed grain ratio is not more than 5%.

If the grain size number of austenite crystal grain is less than 2.0 in the austenitic alloy pipe of the above described chemical composition, the anisotropy of strength increases as shown in FIG. 4. Specifically, a ratio of the yield strength (compressive YS) obtained by compression test to the yield strength (tensile YS) obtained by tensile test (=compressive YS/tensile YS) will become less than 0.85. In this case, the austenitic alloy pipe may not be suitable for use as an oil country tubular good for inclined shaft bores. Further, as shown in FIG. 1, detectability in ultrasonic flaw detection remarkably deteriorates. On the other hand, when grain size number of grain is more than 7.0, a high reduction of area in cold working is required, and flaws such as scoring become likely to occur on the surface of the austenitic alloy pipe during production process. The austenitic alloy pipe of the present embodiment has a grain size number of austenite crystal grain conforming to ASTM E112 of 2.0 to 7.0. For that reason, the anisotropy of strength is small, and specifically the ratio of the yield strength obtained by compression test (compressive YS) to the yield strength obtained by tensile test (tensile YS) (=compressive YS/tensile YS) will be 0.85 to 1.10. For that reason, the austenitic alloy pipe exhibits excellent durability even when used in various environments in which stress is applied in different manners. Further, it exhibits excellent detectability in ultrasonic flaw detection. Further, occurrence of flaws such as scoring on the surface of the austenitic alloy pipe is suppressed in the production process. A lower limit of grain size number is preferably 2.1, more preferably 2.5, further preferably 2.7, and further preferably 3.0. An upper limit of grain size number is preferably 6.9, more preferably 6.8, and further preferably 6.7.

[Measurement Method of Grain Size Number]

A measurement method of grain size number of austenite crystal grain in an austenitic alloy pipe is as follows. The main body region 100 shown in FIG. 2 is divided into five equal parts in the axial direction. In each section, sample pick-up positions are selected at a pitch of 90 degrees in the pipe circumferential direction. Samples are picked up from a wall-thickness middle part of each of the selected sample pick-up positions. The observation surface of sample is a section perpendicular to the axial direction (longitudinal direction) of the austenitic alloy pipe, and the area of the observation surface is, for example, 40 $mm^2$.

In the above described manner, four samples in each section, and twenty (5 sections×four) samples are picked up in all the sections. The observation surface of each picked-up sample is etched with Kalling etching solution to reveal grain boundaries of austenite on the surface. The etched observation surface is observed to determine a grain size number of austenite crystal grain conforming to ASTM E112.

An average value of grain size numbers of austenite crystal grain determined from twenty samples is defined as a grain size number conforming to ASTM E112 in the austenitic alloy pipe.

[Mixed Grain Ratio]

Further, in the austenitic alloy pipe of the present embodiment, the microstructure is substantially in a state of regulated grain. More specifically, among twenty samples picked up from the wall-thickness middle parts of the austenitic alloy pipe, a proportion (mixed grain ratio) of the number of samples in which a state of "mixed grain" has occurred is not more than 5%.

When the mixed grain ratio is more than 5%, variation in grain size in an austenitic alloy pipe is large. In such a case, SCC resistance deteriorates in the austenitic alloy of the above described chemical composition.

The microstructure of the austenitic alloy pipe of the present embodiment has a mixed grain ratio of not more than 5%, and is substantially in a state of regulated grain. For that reason, even a large-diameter austenitic alloy pipe having the above described chemical composition and an outer diameter of not less than 170 mm has excellent SCC resistance. A preferable mixed grain ratio is 0%.

[Measurement Method of Mixed Grain Ratio]

Mixed grain ratio can be determined in the following manner. The main body region 100 shown in FIG. 2 is divided into five equal parts in the axial direction (longitudinal direction) of the alloy pipe. In each section, sample pick-up positions are selected at a pitch of 90 degrees in the pipe circumferential direction. A sample is picked up from a wall-thickness middle part of each of the selected sample pick-up positions. The observation surface of the sample is a section perpendicular to the axial direction of the austenitic alloy pipe, and the area of the observation surface is, for example, 40 $mm^2$.

In the above described manner, four samples in each section, and twenty samples in all the sections were picked up. The observation surface of each picked-up sample was etched with Kalling$\overline{s}$ etching solution to reveal grain boundaries on the surface. The etched observation surface was observed to determine a grain size number conforming to ASTM E112.

In this occasion, in the observation surface of each sample, a grain having a grain size number which is different by 3 points or more in the grain size number from that of a grain having a grain size number with a maximum frequency is identified as a "heterogeneous grain". When the area fraction of heterogeneous grain is not less than 20% in the observation surface, it is recognized that a state of "mixed grain" has occurred in that sample.

Among the above described twenty samples, a sample in which a state of mixed grain has occurred is defined as a "mixed grain sample". As shown in the following formula, a ratio of a total number of mixed grain samples to a total number of samples (20) is defined as a mixed grain ratio (%).

$$\text{Mixed grain ratio}(\%)=\text{Total number of mixed grain samples/total number of samples}\times 100$$

As described so far, when in each of twenty samples picked up from wall-thickness middle positions of an austenitic alloy pipe, grain size numbers conforming to ASTM E112 are determined, and a sample, in which area of grains having a grain size number which is different by 3 points or more in the grain size number from that of a grain having a grain size number with a maximum frequency is not less than 20%, is defined as a mixed grain sample, a proportion (%) of the total number of mixed grain samples to the total number of samples is defined as a mixed grain ratio.

In the austenitic alloy pipe of the present embodiment, the mixed grain ratio is not more than 5%. In other words, it is approximately in a state of regulated grain. When the mixed grain ratio is more than 5%, SCC resistance may become low. Since the mixed grain ratio of the austenitic alloy pipe of the present embodiment is not more than 5%, excellent SCC resistance can be achieved based on the premise that other requirements are satisfied.

[Yield Strength and Compressive YS/Tensile YS]

In the austenitic alloy pipe of the present embodiment, when yield strength obtained by tensile test is defined as "tensile YS", the tensile YS is not less than 758 MPa. Further, when yield strength obtained by compression test is defined as "compressive YS", compressive YS/tensile YS is 0.85 to 1.10.

The austenitic alloy pipe of the present embodiment has a yield strength of not less than 110 ksi grade (tensile YS is 758 to 861 MPa). Further, it has an anisotropy index AN (compressive YS/tensile YS) of 0.85 to 1.10 while having a yield strength of not less than 110 ksi grade. For that reason, the large-diameter austenitic alloy pipe of the present embodiment having a diameter of not less than 170 mm is durable for uses in various environments in which distribution of applied stress is different.

A lower limit of tensile YS is preferably 760 MPa, more preferably 770 MPa, and further preferably 780 MPa. An upper limit of tensile YS is, though not particularly limited, for example, 1000 MPa. The upper limit of tensile YS may be, for example, 965 MPa.

A lower limit of compressive YS/tensile YS is preferably 0.86, more preferably 0.87, and further preferably 0.88. An upper limit of compressive YS/tensile YS is preferably 1.08, more preferably 1.07, and further preferably 1.06.

Tensile YS is measured in the following manner. The main body region 100 shown in FIG. 2 is divided into five equal parts in the axial direction of alloy pipe. Tensile test specimens are picked up from wall-thickness middle parts of each section. The tensile test specimen conforms to ASTM E8M-16a specification, and has a parallel-portion diameter of 6 mm and a parallel-portion length of 30 mm. The parallel portion of the tensile test specimen is parallel with the axial direction (longitudinal direction) of austenitic alloy pipe. The tensile test is performed conforming to ASTM E8M-16a at the room temperature (25°) in the atmosphere. An average of obtained five yield strengths is defined as yield strength obtained by tensile test (tensile YS in the unit of MPa). Where, the yield strength means 0.2% proof stress.

Compressive YS is measured in the following manner. The main body region 100 shown in FIG. 2 is divided into five equal parts in the axial direction of alloy pipe. Compression test specimens are picked up from wall-thickness middle parts of each section. The compression test specimen is column shaped and has a diameter of 6.35 mm and a length of 12.7 mm. The longitudinal direction of the compression test specimen is parallel with the axial direction (longitudinal direction) of the austenitic alloy pipe. Using an Instron-type compression test machine, compression test is performed conforming to ASTM E9-09 at the room temperature (25° C.) in the atmosphere. An average of obtained five yield strengths is defined as yield strength obtained by compression test (compressive YS in the unit of MPa). Where, the yield strength means 0.2% proof stress.

By using obtained tensile YS and compressive YS, an anisotropy index AN (=compressive YS/tensile YS) is determined.

[Production Method]

An example of the method for producing an austenitic alloy pipe of the present embodiment will be described. Note that the method for producing an austenitic alloy pipe of the present embodiment is not limited to this production method.

The method for producing an austenitic alloy pipe of the present embodiment includes a starting material production step, a hollow shell production step, an intermediate cold working step, a grain refining step, and a final cold working step. In the production method of the present embodiment, a reduction of area Rd0 in the starting material production step, a reduction of area Rd1 in the hollow shell production step, a reduction of area Rd2 in the intermediate cold working step, and a reduction of area Rd3 in the final cold working step are adjusted respectively, and also adjusted such that reductions of area Rd0 to Rd2 satisfy a particular relationship. Hereinafter, each production step of the production method of the present embodiment will be described in detail.

[Starting Material Production Step]

In the starting material production step, a cast piece produced by a continuous casting process is subjected to hot working to produce a starting material. The starting material to be produced in the starting material production step is, for example, a round billet. Hereinafter, the starting material production step will be described.

In the starting material production step, first, a prepared cast piece is heated. Heating of the cast piece is conducted in a reheating furnace or holding furnace. The heating temperature is, for example, 1100 to 1350° C. The holding time at this heating temperature is, for example, 2.0 to 5.0 hours. The heated cast piece is subjected to hot working to produce a starting material. The hot working may be blooming by use of a blooming mill, or hot forging by use of a forging mill.

The area of a section (cross section) perpendicular to the axial direction (longitudinal direction) of the cast piece before hot working of the starting material production step is defined as Acc, and the area of a section (cross section) perpendicular to the axial direction (longitudinal direction) of the starting material after hot working of the starting material production step is defined as Arm. In this case, the reduction of area Rd0(%) in the hot working in the starting material production step is defined by the following formula.

$$\text{Reduction of area } Rd0=\{1-(Arm/Acc)\}\times 100$$

The reduction of area Rd0 in the hot working in the starting material production step is 50.0 to 90.0%. When the reduction of area Rd0 is less than 50.0%, the grain size number of the austenitic alloy pipe after the final cold working step may become less than 2.0, even if other production conditions are satisfied, or the mixed grain ratio may become more than 5% even if the grain size number is in a range of 2.0 to 7.0. Accordingly, the reduction of area Rd0 is not less than 50.0%. A lower limit of the reduction of area Rd0 is preferably 55.0%, and more preferably 60.0%.

Note that if the reduction of area Rd0 is too high, the reduction of area in the hot working in the starting material production step will become too high. This will make it more likely that flaws occur on the surface of the hollow shell after hot working. In such a case, flaws may remain on the surface of the austenitic alloy pipe after the final cold working step. Accordingly, the upper limit of the reduction of area Rd0 is 90.0%. An upper limit of the reduction of area Rd0 is preferably 88.0%, and more preferably 85.0%.

[Hollow Shell Production Step]

In the hollow shell production step, the starting material is subjected to hot working to produce a hollow shell. Specifically, the prepared starting material is heated. The heating of the starting material is conducted by, for example, a reheating furnace or holding furnace. The heating temperature of the starting material is, for example, 1100 to 1300° C.

For the hot working, the Mannesmann process may be adopted, or hot extrusion typified by the Ugine-Sejournet process may be adopted. When the Mannesmann process is adopted, the hollow shell is produced by subjecting the starting material to piercing and rolling by use of a piercing machine with a plurality of skew rolls and a plug. The hollow shell produced by the piercing machine may further be subjected to drawing and rolling by use of a mandrel mill, etc. Further, the hollow shell after the drawing and rolling may be subjected to diameter adjusting rolling by use of a sizer, a reducer, and the like.

The area of a cross section of the starting material before the hot working of the hollow shell production step is defined as Arm, and the area of a section (cross section) perpendicular to the axial direction of the hollow shell after the hot working of the hollow shell production step is defined as Ahs1. In this case, the reduction of area Rd1(%) in the hot working in the hollow shell production step is defined by the following formula.

$$\text{Reduction of area } Rd1=\{1-(Ahs1/Arm)\}\times 100$$

The reduction of area Rd 1 in the hot working in the hollow shell production step is 80.0 to 95.0%. When the reduction of area Rd1 is less than 80.0%, the grain size number of the austenitic alloy pipe after the final cold working step may become less than 2.0, even if other production conditions are satisfied, or the mixed grain ratio may become more than 5% even if the grain size number is in a range of 2.0 to 7.0. Further, the tensile YS may become less than 758 MPa even if other production conditions are satisfied. Accordingly, the reduction of area Rd1 is not less than 80.0%. A lower limit of the reduction of area Rd1 is preferably 82.0%, and more preferably 85.0%.

On the other hand, when the reduction of area Rd1 is too high, the reduction of area in the hot working in the hollow shell production step will be too high. In such a case, flaws become likely to occur on the surface of the hollow shell. As a result of that, flaws may remain on the surface of the austenitic alloy pipe after the final cold working step. Accordingly, the upper limit of the reduction of area Rd1 is 95.0%. An upper limit of the reduction of area Rd1 is preferably 93.0%, and more preferably 90.0%.

[Intermediate Cold Working Step]

In the intermediate cold working step, the produced hollow shell is further subjected to cold working. This introduces strain in the hollow shell, and causes recrystallization in the following grain refining step, thereby refining grains. The cold working is cold drawing.

The area of a cross section of the hollow shell before the cold working of the intermediate cold working step is defined as Ahs1, and the area of a cross section of the hollow shell after the cold working of the intermediate cold working step is defined as Ahs2. In this case, the reduction of area Rd2(%) in the cold working in the intermediate cold working step is defined by the following formula.

$$\text{Reduction of area } Rd2=\{1-(Ahs2/Ahs1)\}\times 100$$

The reduction of area Rd2 in the cold working in the intermediate cold working step is 10.0 to 30.0%. When the reduction of area Rd2 is less than 10.0%, the grain size number of the austenitic alloy pipe after the final cold working step may become less than 2.0, and tensile YS may become less than 758 MPa even if other production conditions are satisfied. Accordingly, the reduction of area Rd2 is not less than 10.0%. A lower limit of the reduction of area Rd2 is preferably 11.0%, and more preferably 13.0%.

On the other hand, when the reduction of area Rd2 is too high, excessive load will be applied to dies for cold drawing. In this case, scoring will occur in the dies, and flaws are formed on the surface of the hollow shell after the intermediate cold working step. As a result of that, flaws will remain on the surface of the austenitic alloy pipe after the final cold working step. Accordingly, the upper limit of the reduction of area Rd2 is 30.0%. An upper limit of the reduction of area Rd2 is preferably 29.0%, more preferably 28.0%, and further preferably 26.0%.

[Grain Refining Step]

The hollow shell after the intermediate cold working is subjected to a grain refining treatment. Specifically, the hollow shell after the intermediate cold working is heated. The heating temperature is 1000 to 1250° C. When the heating temperature is less than 1000° C., SCC resistance of the hollow shell may deteriorate. On the other hand, when the heating temperature is more than 1250° C., recrystallized grains are coarsened, and the grain size number of the austenitic alloy pipe after the final cold working will be less than 2.0. Accordingly, the heating temperature in the grain refining treatment is 1000 to 1250° C. A lower limit of the heating temperature in the grain refining treatment is preferably 1050° C. An upper limit of the heating temperature in the grain refining treatment is preferably 1200° C., and more preferably 1150° C. The holding time at the above described heating temperature is 1 to 30 minutes. When the holding time is too short, recrystallization will not be sufficiently promoted. On the other hand, when the holding time is too long, recrystallized grains will be coarsened, and the grain size number of the austenitic alloy pipe after the final cold working step will be less than 2.0. Further, tensile YS may become less than 758 MPa. Accordingly, the holding time at the above described heating temperature is 1 to 30 minutes.

After an elapse of the above described holding time, the hollow shell is rapidly cooled to the normal temperature (25° C.). The cooling rate is, for example, not less than 1° C./sec. The cooling method is, though not particularly limited, for example, water cooling. The method of water cooling includes a method in which the hollow shell is immersed in a water tank to be cooled, a method in which the hollow shell is cooled by shower cooling, and the like. Rapid cooling of the hollow shell may be performed by any other method.

[Final Cold Working Step]

The hollow shell after the grain refining treatment is further subjected to cold working to produce an austenitic alloy pipe having a diameter of not less than 170 mm. This final cold working step is intended to adjust the outer diameter and yield strength of the austenitic alloy pipe.

When the area of a cross section of the hollow shell before the cold working of the final cold working step is defined as Ahs2, and the area of a section (cross section) perpendicular to the axial direction of the austenitic alloy pipe after the cold working of the final cold working step is defined as Ahs3, the reduction of area Rd3(%) in the cold working in the final cold working step is defined by the following formula.

$$\text{Reduction of area } Rd3=\{1-(Ahs3/Ahs2)\}\times 100$$

The reduction of area Rd3 in the cold working in the final cold working step is 20.0 to 35.0%. When the reduction of area Rd3 is less than 20.0%, the yield strength (MPa) obtained by tensile test of the austenitic alloy pipe after the final cold working may become less than 758 MPa even if other production conditions are satisfied. On the other hand, if the reduction of area Rd3 is more than 35.0%, excessive load is applied to dies for cold drawing. In this case, scoring occurs in the dies, and flaws are formed on the surface of the hollow shell after the final cold working step. Further, the grain extends in the axial direction, thus increasing anisotropy. In this case, the anisotropy index AN (=compressive YS/tensile YS) may become less than 0.85. Accordingly, the reduction of area Rd3 in the final cold working step is 20.0 to 35.0%. A lower limit of the reduction of area Rd3 is preferably 22.0%, and more preferably 24.0%. An upper limit of the reduction of area Rd3 is preferably 33.0%, more preferably 31.0%, and further preferably 29.0%.

[Formula (1)]

Further, in the above described production step, the reduction of area Rd0 in the starting material production step, the reduction of area Rd1 in the hollow shell production step, and the reduction of area Rd2 in the intermediate cold working step are adjusted so as to satisfy Formula (1).

$$5\times Rd0+10\times Rd1+20\times Rd2\geq 1300 \quad (1)$$

Where, "Rd0" in Formula (1) is substituted by the reduction of area Rd0(%) in the starting material production step. "Rd1" is substituted by the reduction of area Rd1(%) in the hollow shell production step. "Rd2" is substituted by the reduction of area Rd2(%) in the intermediate cold working step.

In the large-diameter austenitic alloy pipe of the present embodiment, to refine austenite grain size and suppress occurrence of mixed grain, not only conditions in each of the above described production steps are satisfied, but also reductions of area Rd0, Rd1, and Rd2 are adjusted so as to satisfy Formula (1) in the three production steps (the starting material production step, hollow shell production step, and intermediate cold working step) before the grain refining step. As a result of this, in a large-diameter austenitic alloy pipe having the above described chemical composition, the grain size number will become in a range of 2.0 to 7.0, and the mixed grain ratio will be not more than 5%.

Definition is made such that F1=5×Rd0+10×Rd1+20×Rd2. Even if the reduction of area Rd0 is 50.0 to 90.0%, and the reduction of area Rd1 is 80.0 to 95.0%, and the reduction of area Rd2 is 10.0 to 30.0%, if F1 is less than 1300, grains will not be sufficiently refined in the grain refining step. As a result of that, the grain size number of austenite crystal grain will become less than 2.0, and the mixed grain ratio will be more than 5%. By adjusting such that the reduction of area Rd0 is 50.0 to 90.0%, and the reduction of area Rd 1 is 80.0 to 95.0%, and the reduction of area Rd2 is 10.0 to 30.0%, and further such that F1 is not less than 1300, it is possible to make the grain size number of austenite crystal grain not less than 2.0 and the mixed grain ratio not more than 5% in the microstructure of the above described large-diameter austenitic alloy pipe. A lower limit of F1 is preferably 1350, and more preferably 1370. Note that the numerical value of F1 is obtained by rounding off the first decimal place of a value obtained by calculation.

Through the production steps described so far, it is possible to produce a large-diameter austenitic alloy pipe having an outer diameter of not less than 170 mm. In spite of that the produced large-diameter austenitic alloy pipe is a large diameter pipe having a diameter of not less than 170 mm, the grain size number of austenite crystal grain is 2.0 to 7.0, and the mixed grain ratio is not more than 5%. Further, the tensile YS is not less than 758 MPa, and the compressive YS/tensile YS is 0.85 to 1.10. For that reason, even if the austenitic alloy pipe has high detectability in ultrasonic flaw detection, and a high strength of not less than 110 ksi grade (758 MPa to 861 MPa), it can suppress anisotropy. Further, since its microstructure is substantially in a state of regulated grain, it exhibits excellent SCC resistance. Furthermore, in spite of that the grain size number is 2.0 to 7.0, flaws are not likely to occur on the surface.

Note that, the above described production method is merely an example, the large-diameter austenitic alloy pipe of the present embodiment may be produced by any other production method. In other words, the production method will not be particularly limited provided that a large-diameter austenitic alloy pipe of the present embodiment, which has the above described chemical composition, and in which the grain size number of austenite crystal grain is 2.0 to 7.0, the mixed grain ratio is not more than 5%, the tensile YS is not less than 758 MPa, the compressive YS/tensile YS is 0.85 to 1.10, and the outer diameter is not less than 170 mm, can be produced. The above described production method is a preferable example to produce the large-diameter austenitic alloy pipe of the present embodiment.

EXAMPLES

Hereinafter, effects of the large-diameter austenitic alloy pipe of the present embodiment will be described more specifically by way of examples. A condition in an example is an exemplary condition which is adopted to confirm the feasibility and effects of the large-diameter austenitic alloy pipe of the present embodiment. Therefore, the large-diameter austenitic alloy pipe of the present embodiment will not be limited to this exemplary condition.

[Production Method]

Blooms or ingots having chemical compositions of Table 1 were produced.

TABLE 1

| Test | Chemical composition (the unit is mass %, the balance is Fe and impurities) | | | | | | | | |
|---|---|---|---|---|---|---|---|---|---|
| No. | C | Si | Mn | P | S | Al | Cu | Ni | Cr |
| 1 | 0.021 | 0.34 | 0.63 | 0.019 | 0.0005 | 0.041 | 0.85 | 29.93 | 25.07 |
| 2 | 0.008 | 0.37 | 0.56 | 0.016 | 0.0002 | 0.034 | 0.78 | 48.73 | 23.90 |
| 3 | 0.019 | 0.26 | 0.61 | 0.022 | 0.0002 | 0.031 | 0.87 | 30.79 | 25.02 |
| 4 | 0.010 | 0.33 | 0.56 | 0.017 | 0.0002 | 0.045 | 0.79 | 48.80 | 24.16 |
| 5 | 0.019 | 0.25 | 0.61 | 0.025 | 0.0004 | 0.081 | 0.81 | 30.47 | 24.72 |
| 6 | 0.010 | 0.28 | 0.53 | 0.015 | 0.0002 | 0.057 | 0.75 | 49.62 | 23.54 |
| 7 | 0.013 | 0.32 | 0.54 | 0.013 | 0.0002 | 0.039 | 0.81 | 30.85 | 24.56 |
| 8 | 0.020 | 0.29 | 0.56 | 0.022 | 0.0003 | 0.049 | 0.85 | 31.17 | 25.35 |
| 9 | 0.014 | 0.30 | 0.58 | 0.014 | 0.0008 | 0.091 | 0.79 | 50.12 | 24.08 |
| 10 | 0.022 | 0.24 | 0.64 | 0.022 | 0.0006 | 0.021 | 0.77 | 31.17 | 24.51 |
| 11 | 0.015 | 0.27 | 0.84 | 0.020 | 0.0010 | 0.049 | 0.76 | 44.30 | 21.80 |
| 12 | 0.009 | 0.28 | 0.63 | 0.011 | 0.0007 | 0.042 | 0.82 | 51.15 | 24.35 |
| 13 | 0.012 | 0.28 | 0.62 | 0.013 | 0.0008 | 0.061 | 0.80 | 51.65 | 24.35 |
| 14 | 0.011 | 0.29 | 0.62 | 0.013 | 0.0007 | 0.088 | 0.80 | 51.65 | 24.35 |
| 15 | 0.012 | 0.28 | 0.61 | 0.010 | 0.0006 | 0.077 | 0.80 | 51.60 | 24.30 |
| 16 | 0.015 | 0.25 | 0.60 | 0.011 | 0.0005 | 0.061 | 0.76 | 50.95 | 23.45 |
| 17 | 0.015 | 0.26 | 0.62 | 0.011 | 0.0005 | 0.051 | 0.77 | 50.60 | 23.65 |
| 18 | 0.015 | 0.25 | 0.61 | 0.011 | 0.0005 | 0.022 | 0.77 | 50.70 | 23.65 |
| 19 | 0.010 | 0.34 | 0.56 | 0.011 | 0.0005 | 0.035 | 0.91 | 50.55 | 24.30 |
| 20 | 0.009 | 0.33 | 0.55 | 0.012 | 0.0005 | 0.022 | 0.91 | 50.60 | 24.25 |
| 21 | 0.008 | 0.34 | 0.56 | 0.012 | 0.0006 | 0.044 | 0.91 | 50.90 | 24.55 |
| 22 | 0.012 | 0.37 | 0.52 | 0.011 | 0.0007 | 0.029 | 0.82 | 31.92 | 25.11 |
| 23 | 0.025 | 0.30 | 1.91 | 0.012 | 0.0002 | 0.040 | 0.81 | 33.50 | 23.20 |
| 24 | 0.019 | 0.31 | 0.60 | 0.011 | 0.0005 | 0.050 | 0.79 | 31.29 | 28.12 |
| 25 | 0.017 | 0.35 | 0.91 | 0.016 | 0.0004 | 0.039 | 0.85 | 34.10 | 21.31 |
| 26 | 0.011 | 0.40 | 0.71 | 0.015 | 0.0008 | 0.041 | 0.88 | 32.81 | 25.10 |
| 27 | 0.015 | 0.39 | 0.59 | 0.018 | 0.0007 | 0.044 | 1.42 | 33.25 | 27.29 |

| Test No. | Mo | N | Ti | W | Nb | Ca | Mg | Nd |
|---|---|---|---|---|---|---|---|---|
| 1 | 2.84 | 0.083 | — | — | — | — | — | — |
| 2 | 6.09 | 0.006 | — | — | — | — | — | — |
| 3 | 2.84 | 0.082 | — | — | — | — | — | — |
| 4 | 6.15 | 0.007 | — | — | — | — | — | — |
| 5 | 2.87 | 0.083 | — | — | — | — | — | — |
| 6 | 6.20 | 0.006 | — | — | — | — | — | — |
| 7 | 2.87 | 0.081 | 0.002 | — | — | — | — | — |
| 8 | 3.17 | 0.090 | — | 0.02 | — | — | — | — |
| 9 | 6.86 | 0.008 | — | — | 0.007 | — | — | — |
| 10 | 3.12 | 0.082 | — | — | — | 0.0030 | — | — |
| 11 | 3.28 | 0.007 | — | — | — | — | — | — |
| 12 | 6.62 | 0.012 | — | — | — | — | — | — |
| 13 | 6.87 | 0.012 | — | — | — | — | — | — |
| 14 | 6.88 | 0.012 | — | — | — | — | — | — |
| 15 | 6.88 | 0.012 | — | — | — | — | — | — |
| 16 | 6.52 | 0.011 | — | — | — | — | — | — |
| 17 | 6.52 | 0.013 | — | — | — | — | — | — |
| 18 | 6.53 | 0.012 | — | — | — | — | — | — |
| 19 | 6.79 | 0.011 | — | — | — | — | — | — |
| 20 | 6.80 | 0.009 | — | — | — | — | — | — |
| 21 | 6.80 | 0.010 | — | — | — | — | — | — |
| 22 | 9.07 | 0.061 | — | — | — | — | — | — |
| 23 | 2.91 | 0.081 | — | — | — | — | 0.0051 | — |
| 24 | 3.15 | 0.091 | — | — | — | — | — | 0.031 |

TABLE 1-continued

| | | | | | | | | |
|---|---|---|---|---|---|---|---|---|
| 25 | 3.55 | 0.079 | 0.010 | 0.21 | — | — | — | — |
| 26 | 4.01 | 0.088 | — | — | — | 0.0050 | 0.0030 | — |
| 27 | 2.87 | 0.071 | 0.012 | — | — | 0.0070 | — | — |

By using the blooms or ingots, austenitic alloy pipes having outer diameter sizes (mm) shown in Table 2 were produced by carrying out each of a starting material production step, a hollow shell production step, an intermediate cold working step, a grain refining step, and a final cold working step, in this order.

TABLE 2

| | Starting material production step | | | Hollow shell production step | | Intermediate cold working step | | | Grain refining step | Final cold working step | | Product size |
|---|---|---|---|---|---|---|---|---|---|---|---|---|
| Test No. | Starting material | Type | Reduction of area Rd0 (%) | Type | Reduction of area Rd1 (%) | Type | Reduction of area Rd2 (%) | F1 | Heating temperature (° C.) | Type | Reduction of area Rd3 (%) | Outer diameter (mm) |
| 1 | CC | Blooming | 70.5 | MM | 87.8 | Cold drawing | 22.9 | 1689 | 1090 | Cold drawing | 23.4 | 179 |
| 2 | CC | Blooming | 85.1 | MM | 81.5 | Cold drawing | 15.2 | 1545 | 1110 | Cold drawing | 27.5 | 179 |
| 3 | CC | Blooming | 2.5 | MM | 83.1 | Cold drawing | 13.6 | 1416 | 1110 | Cold drawing | 23.8 | 246 |
| 4 | CC | Blooming | 57.9 | MM | 82.1 | Cold drawing | 15.2 | 1415 | 1110 | Cold drawing | 27.5 | 246 |
| 5 | CC | Blooming | 53.3 | MM | 91.3 | Cold drawing | 10.2 | 1384 | 1110 | Cold drawing | 24.6 | 296 |
| 6 | CC | Blooming | 79.4 | MM | 89.2 | Cold drawing | 10.5 | 1499 | 1250 | Cold drawing | 29.4 | 275 |
| 7 | CC | Blooming | 61.7 | MM | 85.3 | Cold drawing | 14.5 | 1452 | 1110 | Cold drawing | 23.2 | 245 |
| 8 | CC | Blooming | 75.3 | MM | 86.1 | Cold drawing | 20.9 | 1656 | 1110 | Cold drawing | 23.5 | 263 |
| 9 | CC | Blooming | 3.4 | MM | 92.9 | Cold drawing | 18.5 | 1666 | 1050 | Cold drawing | 25.1 | 258 |
| 10 | CC | Blooming | 71.1 | MM | 90.1 | Cold drawing | 17.1 | 1599 | 1240 | Cold drawing | 21.9 | 246 |
| 11 | It | Blooming | 1.2 | US | 78.6 | Cold drawing | 41.3 | 1868 | 1090 | Cold drawing | 25.3 | 250 |
| 12 | It | Blooming | 52.1 | US | 78.3 | Cold drawing | 18.1 | 1406 | 1090 | Cold drawing | 27.1 | 250 |
| 13 | It | — | — | US | 81.3 | Cold drawing | 9.6 | 1005 | 1110 | Cold drawing | 27.3 | 250 |
| 14 | It | — | — | US | 81.3 | Cold drawing | 9.6 | 1005 | 1110 | Cold drawing | 27.3 | 250 |
| 15 | CC | Blooming | 42.3 | MM | 85.2 | Cold drawing | 22.7 | 1518 | 1100 | Cold drawing | 24.3 | 250 |
| 16 | CC | Blooming | 67.3 | MM | 76.7 | Cold drawing | 22.7 | 1558 | 1100 | Cold drawing | 24.3 | 250 |
| 17 | CC | Blooming | 64.8 | MM | 81.2 | Cold drawing | 35.8 | 1852 | 1100 | Cold drawing | 24.3 | 210 |
| 18 | CC | Blooming | 64.8 | MM | 81.2 | Cold drawing | 7.2 | 1280 | 1100 | Cold drawing | 24.3 | 270 |
| 19 | CC | Blooming | 64.8 | MM | 81.2 | Cold drawing | 22.7 | 1590 | 1280 | Cold drawing | 24.3 | 250 |
| 20 | CC | Blooming | 64.8 | MM | 81.2 | Cold drawing | 22.7 | 1590 | 1100 | Cold drawing | 42.3 | 200 |
| 21 | CC | Blooming | 64.8 | MM | 81.2 | Cold drawing | 22.7 | 1590 | 1100 | Cold drawing | 16.8 | 285 |
| 22 | CC | Blooming | 50.9 | MM | 81.9 | Cold drawing | 10.7 | 1288 | 1090 | Cold drawing | 22.4 | 190 |
| 23 | CC | Blooming | 53.9 | US | 94.2 | Cold drawing | 23.8 | 1688 | 1090 | Cold drawing | 34.7 | 170 |
| 24 | CC | Blooming | 63.7 | MM | 89.7 | Cold drawing | 22.3 | 1662 | 1090 | Cold drawing | 24.3 | 250 |
| 25 | CC | Blooming | 54.1 | US | 91.2 | Cold drawing | 23.9 | 1661 | 1090 | Cold drawing | 24.1 | 250 |
| 26 | CC | Blooming | 64.1 | MM | 88.3 | Cold drawing | 22.9 | 1662 | 1090 | Cold drawing | 25.2 | 210 |
| 27 | CC | Blooming | 64.3 | MM | 91.9 | Cold drawing | 22.7 | 1695 | 1090 | Cold drawing | 26.9 | 210 |

MM: Mannesmann process
US: Hot extrusion

The symbol "CC" in the "Starting material" column of the "Starting material production step" column in Table 2 means that the starting material was a bloom produced by a continuous casting process. The symbol "It" means that the starting material was an ingot. In the starting material production step, the heating temperature was 1270° C. for blooms of all test numbers, and the heating temperature was also 1270° C. for ingots of all test numbers, and the holding time was 2.0 to 5.0 hours. Blooms and ingots of Test Nos. 1 to 12, and 15 to 27 after heating were subjected to blooming to produce round billets. Reductions of area Rd0(%) by blooming in each test number were as shown in Table 2. Note that the round billets of Test Nos. 11 and 12 were subjected to cutting work to form a through hole at the center axis of each round billet.

In the hollow shell production step, the starting material (round billet) produced in the starting material production step was subjected to hot working by means of the production method shown in Table 2. Note that the heating temperature of the starting material was 1100 to 1300° C. in any test number. The symbol "MM" in the "Type" column of the "Hollow shell production step" column in Table 2 means that hot working by the Mannesmann process was performed on the starting material of corresponding test number. In the Mannesmann process of the present example, a hollow shell was produced by performing piercing and rolling by a piercing machine. On the other hand, the symbol "US" means that hot extrusion by the Ugine-Sejournet process was performed on the starting material of corresponding test number. Reductions of area Rd1 in the hot working of the hollow shell production step were as shown in Table 2.

In the intermediate cold working step, the hollow shell produced by the hollow shell production step was subjected to cold working (cold drawing). Reductions of area Rd2 in the intermediate cold working step in each test number were as shown in Table 2.

In the grain refining step, hollow shells of each test number were heated at a heating temperature (° C.) shown in Table 2 for 20 minutes, and thereafter water cooled.

In the final cold working step, each hollow shell after the grain refining step was subjected to cold working (cold drawing) to produce an austenitic alloy pipe. The reductions of area Rd3 in the final cold working step in each test number were as shown in Table 2.

Through the production steps described so far, austenitic alloy pipes of Test Nos. 1 to 27 were produced. A sample was picked up at any position of each of the austenitic alloy pipes, and was subjected to a well-known component analysis. Specifically, C and S in the chemical composition were determined based on a combustion-infrared absorption method (JIS G1121, JIS G1215), N was determined based on an inert gas fusion-thermal conductivity (TCD) method, and other elements were determined based on ICP mass spectroscopy (JIS G1256). As a result of that, the chemical composition of austenitic alloy pipe of each test number was as shown in Table 1.

[Evaluation Test]

[Grain Size Number Measurement Test]

In the austenitic alloy pipe of each test number, the main body region 100 shown in FIG. 2 was divided into five equal parts in the axial direction of alloy pipe. Then, in each section, sample pick-up positions are selected at a pitch of 90 degrees in the pipe circumferential direction. A sample was picked up from a wall-thickness middle part of each of the selected sample pick-up positions (four places). The observation surface of sample was a section perpendicular to the axial direction of the austenitic alloy pipe, and the area of the observation surface was 40 $mm^2$.

In the above described manner, four samples in each section, and twenty samples in all the sections were picked up. The observation surface of each picked-up sample was etched with Kalling etching solution to reveal grain boundaries on the surface. The etched observation surface was observed to determine a grain size number conforming to ASTM E112. An average value of grain size numbers determined from twenty samples was defined as the grain size number conforming to ASTM E112 in the austenitic alloy pipe of each test number.

[Mixed Grain Ratio Measurement Test]

A mixed grain ratio of austenitic alloy pipe of each test number was determined in the following manner. The main body region 100 shown in FIG. 2 was divided into five equal parts in the axial direction of the alloy pipe. Then, in each section, sample pick-up positions were selected at a pitch of 90 degrees in the pipe circumferential direction. A sample was picked up from a wall-thickness middle part of each of the selected sample pick-up positions (four places). The observation surface of sample was a section perpendicular to the axial direction of the austenitic alloy pipe, and the area of the observation surface was 40 $mm^2$.

In the above described manner, four samples in each section, and twenty samples in all the sections were picked up. The observation surface of each picked-up sample was etched with Kalling etching solution to reveal grain boundaries on the surface. The etched observation surface was observed to determine the grain size number. In this occasion, in the observation surface of each sample, a grain having a grain size number which was different by 3 points or more in the grain size number from that of a grain having a grain size number with a maximum frequency was identified as a "heterogeneous grain". When the area fraction of heterogeneous grain was not less than 20% in the observation surface, it was recognized that a state of "mixed grain" had occurred in that sample.

Among the above described twenty samples, a sample in which a state of mixed grain had occurred was defined as a "mixed grain sample". Then, as shown in the following formula, a ratio of the total number of mixed grain samples to the total number (20) of samples was defined as mixed grain ratio (%).

$$\text{Mixed grain ratio}(\%)=\text{Total number of mixed grain samples}/\text{Total number of samples}\times 100$$

[Tensile Test]

Tensile YS of austenitic alloy pipe of each test number was measured in the following manner. The main body region 100 shown in FIG. 2 was divided into five equal parts in the axial direction of alloy pipe. A tensile test specimen was picked up from a wall-thickness middle part of each section. In other words, five tensile test specimens were picked up from an austenitic alloy pipe of each test number. The tensile test specimen had sizes specified in ASTM E8M-16a, and specifically had a parallel-portion diameter of 6 mm and a parallel-portion length of 30 mm. The parallel portion of the tensile test specimen was parallel with the axial direction (longitudinal direction) of austenitic alloy pipe. By using picked-up five tensile test specimens, the tensile test was performed conforming to ASTM E8M-16a at the room temperature (25° C.) in the atmosphere. An average of obtained five yield strengths (0.2% proof stress) was defined as yield strength obtained by tensile test (tensile YS in the unit of MPa).

[Compression Test]

Compressive YS of austenitic alloy pipe of each test number was measured in the following manner. The main body region 100 shown in FIG. 2 was divided into five equal parts in the axial direction of alloy pipe. A compression test specimen was picked up from a wall-thickness middle part of each section. In other words, five compression test specimens were picked up from an austenitic alloy pipe of each test number. The compression test specimen was column-shaped, and had a diameter of 6.35 mm and a length of 12.7 mm. The longitudinal direction of the compression test specimen was in parallel with the axial direction (longitudinal direction) of the austenitic alloy pipe. The picked-up five compression test specimens were subjected to a compression test conforming to ASTM E9-09 at the room temperature (25° C.) in the atmosphere by using an Instron-type compression test machine. An average of obtained five yield strengths (0.2% proof stress) was defined as yield strength obtained by compression test (compressive YS in the unit of MPa).

By using tensile YS and compressive YS, which were obtained by the tensile test and compression test described so far, an anisotropy index AN=Compressive YS/tensile YS was determined.

[Ultrasonic Flaw Detection Detectability Measurement Test]

A main body region 100 of austenitic alloy pipe of each test number was divided into five equal parts in the axial direction of alloy pipe. From each section, an annular sample which had an axial length of 100 mm of alloy pipe was picked up. As shown in FIG. 3, an artificial flaw (hole) 200 extending in the wall thickness direction was made in an axially middle part of the inner surface of each sample. The artificial flaw 200 had a diameter of 3 mm.

An ultrasonic flaw detector was used to output ultrasonic wave toward (to be impinged on) the artificial flaw from an outer surface of the sample, and ultrasonic wave reflected at the artificial flaw was received and observed as an echo. The intensity of impinging ultrasonic wave was the same for every test number.

An average of (a total of five) signal intensities of the echo of the artificial flaw, which were obtained from samples picked up from each section, was defined as a signal intensity in that austenitic alloy pipe.

The signal intensity in the austenitic alloy pipe of Test No. 1 (grain size number was 5.7) of Table 1 was defined as 100. Then, the ratio of the signal intensity obtained in the austenitic alloy pipe of each test number to the signal intensity of Test No. 1 was defined as a signal intensity ratio (%). When the signal intensity ratio was more than 50.0%, the test specimen was judged to be excellent in the detectability in ultrasonic flaw detection.

[SCC Resistance Evaluation Test (SSRT Test)]

Two tensile test specimens were picked up from a wall-thickness middle part of the main body region 100 of an austenitic alloy pipe of each test number. The tensile test specimen conformed to a test specimen specified in NACE TM0198 (2016), in which the diameter of a parallel portion was 3.81 mm, and the length of the parallel portion was 25.4 mm. The parallel portion of the tensile test specimen was parallel with the axial direction (longitudinal direction) of austenitic alloy pipe.

By using a slow strain rate tester (SSRT), the fabricated tensile test specimens were subjected to a tensile test at a strain rate of $4\times10^{-6}$/sec in $H_2S$ gas atmosphere at 200° C. (400° F.) and 100 psi while the test specimen was immersed in 25% NaCl solution to determine a rupture area reduction (%). An average of rupture area reductions of (two) tensile test specimens picked up at each test number was defined as a rupture area reduction (%) of the test number. Further, whether or not a crack (secondary crack) had occurred in reduced portions of the two test specimens was visually confirmed. When no crack had occurred in both reduced portions of the two test specimens, it was recognized that there was no secondary crack. When a crack had occurred in at least one of the two test specimens, it was recognized that there was a secondary crack. When the rupture area reduction was not less than 60.0%, and no secondary crack was observed in the SSRT test, it was judged that the test specimen had excellent SCC resistance.

[Test Results]

Test results are shown in Table 3.

TABLE 3

| | Structure specification | | Mechanical properties | | | | | | |
|---|---|---|---|---|---|---|---|---|---|
| Test No. | Grain size number | Mixed grain ratio (%) | Tensile YS (MPa) | Anisotropy Compressive YS/tensile YS | Signal intensity ratio | SSRT Area reduction (%) | SSRT Secondary crack | Surface flaw | Remarks |
| 1 | 5.7 | Not more than 5 | 903 | 1.01 | 100 | 65.6 | None | None | Inventive example |
| 2 | 3.2 | Not more than 5 | 928 | 0.88 | 78.9 | 63.4 | None | None | Inventive example |
| 3 | 3.5 | Not more than 5 | 831 | 0.96 | 79.4 | 65.2 | None | None | Inventive example |
| 4 | 4.2 | Not more than 5 | 830 | 0.91 | 81.2 | 66.1 | None | None | Inventive example |
| 5 | 3.0 | Not more than 5 | 795 | 0.95 | 79.4 | 62.2 | None | None | Inventive example |
| 6 | 2.1 | Not more than 5 | 810 | 0.86 | 51.3 | 61.7 | None | None | Inventive example |
| 7 | 3.7 | Not more than 5 | 822 | 0.96 | 80.3 | 63.9 | None | None | Inventive example |
| 8 | 4.8 | Not more than 5 | 844 | 0.95 | 83.7 | 67.4 | None | None | Inventive example |
| 9 | 6.8 | Not more than 5 | 917 | 0.92 | 101.3 | 68.1 | None | None | Inventive example |
| 10 | 2.1 | Not more than 5 | 806 | 1.06 | 52.7 | 62.1 | None | None | Inventive example |
| 11 | 7.2 | Not more than 5 | 882 | 0.88 | 101.3 | 67.8 | None | Observed | Comparative example |
| 12 | 6.3 | 10 | 791 | 0.86 | 99.8 | 51.2 | Observed | None | Comparative example |
| 13 | −1.0 | 15 | 790 | 0.82 | 5.6 | 62.8 | Observed | None | Comparative example |
| 14 | −2.3 | 20 | 783 | 0.81 | 1.5 | 53.8 | None | None | Comparative example |
| 15 | 1.8 | 10 | 760 | 0.83 | 49.7 | 51.1 | Observed | None | Comparative example |
| 16 | 1.9 | 10 | 751 | 0.79 | 48.9 | 53.7 | Observed | None | Comparative example |
| 17 | 7.3 | Not more than 5 | 903 | 0.91 | 100 | 63.4 | None | Observed | Comparative example |
| 18 | 0.3 | 10 | 740 | 0.82 | 7.8 | 58.7 | None | None | Comparative example |
| 19 | 1.3 | Not more than 5 | 723 | 0.74 | 39.8 | 69.7 | None | None | Comparative example |
| 20 | 9.7 | Not more than 5 | 942 | 0.73 | 101.1 | 61.2 | None | Observed | Comparative example |
| 21 | 2.3 | Not more than 5 | 710 | 0.88 | 52.1 | 60.0 | None | None | Comparative example |
| 22 | 1.6 | 15 | 712 | 0.82 | 31.2 | 53.1 | Observed | None | Comparative example |
| 23 | 6.5 | Not more than 5 | 810 | 0.86 | 78.1 | 68.1 | None | None | Inventive example |
| 24 | 6.1 | Not more than 5 | 951 | 0.88 | 81.1 | 62.1 | None | None | Inventive example |
| 25 | 6.3 | Not more than 5 | 798 | 0.91 | 75.3 | 67.3 | None | None | Inventive example |
| 26 | 5.1 | Not more than 5 | 785 | 0.93 | 59.1 | 67.9 | None | None | Inventive example |
| 27 | 5.9 | Not more than 5 | 831 | 0.89 | 77.1 | 69.1 | None | None | Inventive example |

Referring to Table 3, in the austenitic alloy pipes of Test Nos. 1 to 10, and 23 to 27, the chemical composition was appropriate and also production condition was appropriate. For that reason, even though the outer diameter was not less than 170 mm, the grain size number was 2.0 to 7.0 and the mixed grain ratio was not more than 5%. For that reason, the signal intensity ratio was not less than 50.0%, exhibiting excellent detectability in ultrasonic flaw detection test. Further, in the SSRT test, the value of rupture area reduction was not less than 60.0%, and no secondary crack had occurred, thus exhibiting excellent SCC resistance. Further, the tensile YS was not less than 758 MPa. Moreover, the anisotropy index AN (=compressive YS/tensile YS) was 0.85 to 1.10, and thus strength anisotropy was suppressed. Further, there was no surface flaw observed.

On the other hand, in Test No. 11, the reduction of area Rd1 in the hollow shell production step was too low, and the reduction of area Rd2 in the intermediate cold working step was too high. For that reason, the grain size number was more than 7.0, and a surface flaw was observed. Since the reduction of area Rd2 in the intermediate cold working step was too high, it is conceivable that scoring occurred in the dies and, as a result of that, a surface flaw occurred.

In Test No. 12, the reduction of area Rd1 in the hollow shell production step was too low. For that reason, although the grain size number was in a range of 2.0 to 7.0, the mixed grain ratio was more than 5%. As a result of that, in the SSRT test, the rupture area reduction was less than 60.0%, and a secondary crack was confirmed, exhibiting poor SCC resistance.

In Test Nos. 13 and 14, the starting material production step was not conducted, and the reduction of area Rd2 in the intermediate cold working step was low. As a result of that, the grain size number was less than 2.0, and the mixed grain ratio was more than 5%. For that reason, the compressive YS/tensile YS was less than 0.85, thus exhibiting strong anisotropy. Further, the signal intensity ratio was less than 50.0%, exhibiting low detectability in ultrasonic flaw detection. Further, the rupture area reduction was less than 60.0% in the SSRT test, or a secondary crack occurred, exhibiting poor SCC resistance.

In Test No. 15, the reduction of area Rd0 in the starting material production step was low. For that reason, the grain size number was less than 2.0, and the mixed grain ratio was more than 5%. For that reason, the compressive YS/tensile YS was less than 0.85, thus exhibiting strong anisotropy. Further, the signal intensity was less than 50.0%, thus exhibiting low detectability in ultrasonic flaw detection. Further, the rupture area reduction in the SSRT test was less than 60.0% and a secondary crack occurred, thus exhibiting poor SCC resistance.

In Test No. 16, the reduction of area Rd1 in the hollow shell production step was low. As a result of that, the grain size number was less than 2.0, and the mixed grain ratio was more than 5%. For that reason, the compressive YS/tensile YS was less than 0.85, thus exhibiting strong anisotropy. Further, the signal intensity was less than 50.0%, thus exhibiting low detectability in ultrasonic flaw detection. Further, the rupture area reduction in the SSRT test was less than 60.0%, thus exhibiting poor SCC resistance. Moreover, the tensile YS was less than 758 MPa.

In Test No. 17, the reduction of area Rd2 in the intermediate cold working step was high. For that reason, the grain size number was more than 7.0, and a surface flaw occurred.

In Test No. 18, the reduction of area Rd2 in the intermediate cold working step was low. For that reason, the grain size number was less than 2.0, and the mixed grain ratio was more than 5%. For that reason, the compressive YS/tensile YS was less than 0.85, thus exhibiting strong strength anisotropy. Further, the signal intensity was less than 50.0%, thus exhibiting low detectability in ultrasonic flaw detection. Further, the rupture area reduction in the SSRT test was less than 60.0%, thus exhibiting poor SCC resistance. Moreover, the tensile YS was less than 758 MPa.

In Test No. 19, the heating temperature in the grain refining step was too high. For that reason, the grain size number was less than 2.0, and the tensile YS was less than 758 MPa. For that reason, the compressive YS/tensile YS was less than 0.85, thus exhibiting strong anisotropy. Further, the signal intensity was less than 50.0%, thus exhibiting low detectability in ultrasonic flaw detection.

In Test No. 20, the reduction of area Rd3 in the final cold working step was too high. For that reason, the grain size number was more than 7.0. As a result of that, the compressive YS/tensile YS was less than 0.85, thus exhibiting strong anisotropy. This was conceivably because the grain was extended too far in the axial direction. Further, a surface flaw occurred in Test No. 20.

In Test No. 21, the reduction of area Rd3 in the final cold working step was too low. For that reason, the tensile YS was less than 758 MPa.

In Test No. 22, F1 did not satisfy Formula (1). For that reason, the grain size number was less than 2.0, and the mixed grain ratio was more than 5%. As a result of that, the compressive YS/tensile YS was less than 0.85, thus exhibiting strong strength anisotropy. Further, the signal intensity ratio was less than 50.0%, thus exhibiting low detectability in ultrasonic flaw detection. Further, the rupture area reduction in the SSRT test was less than 60.0%, thus exhibiting poor SCC resistance. Moreover, the tensile YS was less than 758 MPa.

So far embodiments of the present invention have been described. However, the above described embodiments are merely exemplification for carrying out the present invention. Therefore, the present invention can be carried out, without being limited to the above described embodiments, by appropriately modifying the above described embodiments within a range not departing from the spirit thereof.

REFERENCE SIGNS LIST

11 First pipe end
12 Second pipe end
100 Main body region
110 First pipe-end region
120 Second pipe-end region

The invention claimed is:

1. An austenitic alloy pipe, having a chemical composition consisting of, in mass %:

C: 0.004 to 0.030%,
Si: 1.00% or less,
Mn: 0.30 to 2.00%,
P: 0.030% or less,
S: 0.0020% or less,
Al: 0.001 to 0.100%,
Cu: 0.50 to 1.50%,
Ni: 25.00 to 55.00%,
Cr: 20.00 to 30.00%,
Mo: 2.00 to 10.00%,
N: 0.005 to 0.100%,
W: 0 to 0.30%,
Nb: 0 to 0.050%,
Ca: 0 to 0.0100%,
Mg: 0 to 0.0100%, and
Nd: 0 to 0.050%, with the balance being Fe and impurities, wherein a grain size number of austenite crystal grain is 2.0 to 4.8 and a mixed grain ratio is not more than 5%, wherein when a yield strength obtained by a compression test is defined as a compressive YS (MPa) and a yield strength obtained by a tensile test as a tensile YS (MPa), the tensile YS is not less than 758 MPa and the compressive YS/tensile YS is 0.85 to 1.10, and wherein the austenitic alloy pipe has an outer diameter of not less than 170 mm.

2. The austenitic alloy pipe according to claim 1, wherein the chemical composition contains one or more types of element selected from the group consisting of:

W: 0.02 to 0.30%, and

Nb: 0.001 to 0.050%.

3. The austenitic alloy pipe according to claim 2, wherein the chemical composition contains one or more types of element selected from the group consisting of:

Ca: 0.0003 to 0.0100%,

Mg: 0.0005 to 0.0100%, and

Nd: 0.010 to 0.050%.

4. The austenitic alloy pipe according to claim 1, wherein the chemical composition contains one or more types of element selected from the group consisting of:

Ca: 0.0003 to 0.0100%,

Mg: 0.0005 to 0.0100%, and

Nd: 0.010 to 0.050%.

5. The austenitic alloy pipe according to claim 1, wherein the chemical composition includes, in mass %:

Al: 0.005 to 0.100%.

6. A method for producing an austenitic alloy pipe according to claim 1, comprising:

a starting material production step, in which a cast piece which has been produced by a continuous casting process and has the chemical composition according to claim 5 is heated at 1100 to 1350° C., and thereafter subjected to hot working at a reduction of area Rd0 which is in a range of 50.0 to 90.0% and satisfies Formula (1) to produce a starting material:

$$5\times Rd0+10\times Rd1+20\times Rd2\geq 1300 \quad (1);$$

a hollow shell production step, in which the starting material is heated at 1100 to 1300° C., and thereafter subjected to hot working at a reduction of area Rd1 which is in a range of 80.0 to 95.0% and satisfies Formula (1), to produce a hollow shell;

an intermediate cold working step, in which the hollow shell is subjected to cold drawing at a reduction of area Rd2 which is in a range of 10.0 to 30.0% and satisfies Formula (1);

a grain refining step, in which the hollow shell after the intermediate cold working step is held at 1000 to 1250° C. for 1 to 30 minutes and thereafter rapidly cooled; and a final cold working step, in which the hollow shell after the grain refining step is subjected to cold drawing at a reduction of area Rd3 of 20.0 to 35.0% to produce the austenitic alloy pipe with an outer diameter of not less than 170 mm.

7. An austenitic alloy pipe, having a chemical composition consisting of, in mass %:

C: 0.004 to 0.030%,
Si: 1.00% or less,
Mn: 0.30 to 2.00%,
P: 0.030% or less,
S: 0.0020% or less,
Al: 0.001 to 0.100%,
Cu: 0.50 to 1.50%,
Ni: 25.00 to 55.00%,
Cr: 20.00 to 30.00%,
Mo: 2.00 to 10.00%,
N: 0.005 to 0.100%,
Ti: 0.012 to 0.800%,
W: 0 to 0.30%,
Nb: 0 to 0.050%,
Ca: 0 to 0.0100%,
Mg: 0 to 0.0100%, and
Nd: 0 to 0.050%, with the balance being Fe and impurities, wherein a grain size number of austenite crystal grain is 2.0 to 4.8 and a mixed grain ratio is not more than 5%, wherein when a yield strength obtained by a compression test is defined as a compressive YS (MPa) and a yield strength obtained by a tensile test as a tensile YS (MPa), the tensile YS is not less than 758 MPa and the compressive YS/tensile YS is 0.85 to 1.10, and wherein the austenitic alloy pipe has an outer diameter of not less than 170 mm.

8. The austenitic alloy pipe according to claim 7, wherein the chemical composition contains one or more types of element selected from the group consisting of:

W: 0.02 to 0.30%, and

Nb: 0.001 to 0.050%.

9. The austenitic alloy pipe according to claim 8, wherein the chemical composition contains one or more types of element selected from the group consisting of:

Ca: 0.0003 to 0.0100%,

Mg: 0.0005 to 0.0100%, and

Nd: 0.010 to 0.050%.

10. The austenitic alloy pipe according to claim 7, wherein the chemical composition contains one or more types of element selected from the group consisting of:

Ca: 0.0003 to 0.0100%,

Mg: 0.0005 to 0.0100%, and

Nd: 0.010 to 0.050%.

* * * * *